US011293673B1

(12) United States Patent
Vaisman et al.

(10) Patent No.: US 11,293,673 B1
(45) Date of Patent: Apr. 5, 2022

(54) THERMAL MANAGEMENT SYSTEMS

(71) Applicant: Booz Allen Hamilton Inc., McLean, VA (US)

(72) Inventors: Igor Vaisman, Carmel, TN (US); Joshua Peters, Knoxville, TN (US)

(73) Assignee: Booz Allen Hamilton Inc., McLean, VA (US)

( * ) Notice: Subject to any disclaimer, the term of this patent is extended or adjusted under 35 U.S.C. 154(b) by 85 days.

(21) Appl. No.: 16/666,954

(22) Filed: Oct. 29, 2019

Related U.S. Application Data

(60) Provisional application No. 62/754,104, filed on Nov. 1, 2018.

(51) Int. Cl.

| | |
|---|---|
| ***F25B 19/00*** | (2006.01) |
| ***F25B 49/00*** | (2006.01) |
| ***F25B 43/00*** | (2006.01) |
| ***F25B 39/02*** | (2006.01) |
| ***F25B 45/00*** | (2006.01) |
| ***F25B 41/20*** | (2021.01) |

(52) U.S. Cl.
CPC ..... *F25B 19/00* (2013.01); *F25B 39/028* (2013.01); *F25B 41/20* (2021.01); *F25B 43/003* (2013.01); *F25B 45/00* (2013.01); *F25B 49/00* (2013.01); *F25B 2341/0013* (2013.01); *F25B 2400/16* (2013.01); *F25B 2700/19* (2013.01)

(58) Field of Classification Search
CPC ..... F25B 19/00; F25B 41/20; F25B 41/31; F25B 39/028; F25B 45/00; F25B 49/00; F25B 2341/0013; F25B 2700/19
See application file for complete search history.

(56) References Cited

U.S. PATENT DOCUMENTS

| | | | |
|---|---|---|---|
| 1,836,318 | A | 12/1931 | Gay |
| 2,489,514 | A | 11/1949 | Benz |
| 2,526,221 | A | 10/1950 | Goddard |
| 2,785,540 | A | 3/1957 | Biehn |
| 3,300,996 | A | 1/1967 | Atwood |
| 3,468,421 | A | 9/1969 | Hazel et al. |
| 3,542,338 | A | 11/1970 | Scaramucci |
| 3,685,310 | A | 8/1972 | Bitter et al. |
| 3,789,583 | A | 2/1974 | Smith |
| 3,866,427 | A | 2/1975 | Rothmayer et al. |

(Continued)

OTHER PUBLICATIONS

U.S. Appl. No. 16/448,271, filed Jun. 21, 2019, entitled "Thermal Management Systems."

(Continued)

*Primary Examiner* — Kun Kai Ma
(74) *Attorney, Agent, or Firm* — Fish & Richardson P.C.

(57) ABSTRACT

A thermal management system is described. The thermal management system includes an open circuit refrigeration circuit that has a refrigerant fluid flow path, with the refrigerant fluid flow path including a receiver configured to store a refrigerant fluid, an ejector having a primary flow inlet configured to receive refrigerant, a liquid separator, an evaporator configured to extract heat from a heat load that contacts the evaporator, with the evaporator coupled to the ejector and the liquid separator, and an exhaust line coupled to a vapor side outlet of the liquid separator. In operation, the evaporator in the open circuit refrigeration circuit would be coupled to a heat load.

44 Claims, 16 Drawing Sheets

(56) References Cited

U.S. PATENT DOCUMENTS 4,015,439 A 4/1977 Stern
4,016,657 A 4/1977 Passey
4,054,433 A 10/1977 Buffiere et al.
4,151,724 A 5/1979 Garland
4,169,361 A 10/1979 Baldus
4,275,570 A 6/1981 Szymaszek et al.
4,323,109 A 4/1982 Jaster
4,352,272 A 10/1982 Taplay
4,419,865 A 12/1983 Szymaszek
4,539,816 A 9/1985 Fox
4,870,830 A 10/1989 Hohenwarter et al.
4,969,495 A 11/1990 Grant
5,094,277 A 3/1992 Grant
5,127,230 A 7/1992 Neeser et al.
5,176,008 A 1/1993 Van Steenburgh, Jr.
5,187,953 A 2/1993 Mount
5,245,840 A 9/1993 Van Steenburgh, Jr.
5,297,392 A 3/1994 Takata et al.
5,325,894 A 7/1994 Kooy et al.
5,353,603 A 10/1994 Outlaw et al.
5,360,139 A 11/1994 Goode
5,471,848 A 12/1995 Major et al.
5,513,961 A 5/1996 Engdahl et al.
5,690,743 A 11/1997 Murakami et al.
5,762,119 A 6/1998 Platz et al.
5,974,812 A 11/1999 Káatai et al.
6,044,647 A 4/2000 Drube et al.
6,076,360 A 6/2000 Viegas et al.
6,230,518 B1 5/2001 Hahn et al.
6,314,749 B1 11/2001 Van Steenburgh, Jr.
6,354,088 B1 3/2002 Emmer et al.
6,381,972 B1 5/2002 Cotter
6,474,101 B1 11/2002 Quine et al.
6,564,578 B1 5/2003 Fischer-Calderon
6,964,168 B1 11/2005 Pierson et al.
7,377,126 B2 5/2008 Gorbounov et al.
7,497,180 B2 3/2009 Karlsson et al.
7,891,197 B2 2/2011 Winter
7,987,685 B2 8/2011 Oshitani et al.
9,267,645 B2 2/2016 Mackey
9,791,221 B1 10/2017 Litch
10,612,821 B1 * 4/2020 Fernando ..... F25B 40/06
11,112,155 B1 9/2021 Vaisman et al.
11,168,925 B1 11/2021 Vaisman et al.
2002/0148225 A1 10/2002 Lewis
2002/0157407 A1 10/2002 Weng
2004/0123624 A1 * 7/2004 Ohta ..... F25B 5/02 62/498
2005/0060970 A1 3/2005 Polderman
2005/0201429 A1 9/2005 Rice et al.
2006/0207285 A1 * 9/2006 Oshitani ..... F25B 41/00 62/500
2006/0218964 A1 * 10/2006 Saito ..... F25B 6/04 62/500
2007/0007879 A1 1/2007 Bergman, Jr. et al.
2008/0092559 A1 4/2008 Williams et al.
2008/0148754 A1 6/2008 Snytsar
2009/0158727 A1 6/2009 Marsala
2009/0211298 A1 8/2009 Saul
2009/0219960 A1 9/2009 Uberna et al.
2009/0228152 A1 9/2009 Anderson et al.
2010/0098525 A1 4/2010 Guelich
2010/0154395 A1 6/2010 Frick
2011/0114284 A1 5/2011 Siegenthaler
2012/0167601 A1 * 7/2012 Cogswell ..... F25B 1/10 62/115
2012/0204583 A1 8/2012 Liu
2012/0312379 A1 * 12/2012 Gielda ..... F25B 41/00 137/1
2013/0000341 A1 1/2013 De Piero et al.
2013/0025305 A1 * 1/2013 Higashiiue ..... F25B 31/004 62/115
2013/0104593 A1 * 5/2013 Occhipinti ..... F25B 41/00 62/498
2013/0111934 A1 5/2013 Wang et al.
2013/0125569 A1 * 5/2013 Verma ..... F25B 1/06 62/115
2013/0340622 A1 12/2013 Marty et al.
2014/0075984 A1 3/2014 Sugawara et al.
2014/0165633 A1 6/2014 De Piero et al.
2014/0166238 A1 6/2014 Sandu
2014/0260341 A1 9/2014 Vaisman et al.
2014/0331699 A1 * 11/2014 Higashiiue ..... F25B 31/004 62/84
2014/0345318 A1 * 11/2014 Nagano ..... F25B 1/06 62/500
2014/0366563 A1 12/2014 Vaisman et al.
2015/0059379 A1 3/2015 Ootani et al.
2015/0260435 A1 9/2015 Kawano et al.
2015/0263477 A1 9/2015 Onaka
2016/0010907 A1 1/2016 Ali
2016/0114260 A1 4/2016 Frick
2016/0201956 A1 7/2016 Tamura et al.
2016/0216029 A1 7/2016 Ragot
2016/0291137 A1 10/2016 Sakimura et al.
2016/0333747 A1 11/2016 KanFman
2017/0081982 A1 3/2017 Kollmeier et al.
2017/0108263 A1 4/2017 Cermak et al.
2017/0167767 A1 * 6/2017 Shi ..... F25B 43/00
2017/0205120 A1 7/2017 Ali et al.
2017/0299229 A1 10/2017 Carter et al.
2018/0023805 A1 1/2018 Qin et al.
2018/0180307 A1 6/2018 Owejan et al.
2018/0245740 A1 8/2018 Kaminsky et al.
2018/0245835 A1 8/2018 Kamei et al.
2018/0328638 A1 * 11/2018 Mahmoud ..... F25B 41/00
2019/0111764 A1 * 4/2019 Oshitani ..... B60H 1/323
2019/0170425 A1 6/2019 Takami et al.
2019/0203988 A1 7/2019 Kobayashi et al.
2019/0248450 A1 8/2019 Lee et al.
2019/0293302 A1 9/2019 Van et al.
2019/0393525 A1 12/2019 Diethelm et al.
2020/0158386 A1 5/2020 Wu et al.
2020/0239109 A1 7/2020 Lee et al.
2020/0363101 A1 * 11/2020 Jansen ..... F25B 5/04

OTHER PUBLICATIONS

U.S. Appl. No. 16/448,283, filed Jun. 21, 2019, entitled "Thermal Management Systems."
U.S. Appl. No. 16/448,332, filed Jun. 21, 2019, entitled "Thermal Management Systems."
U.S. Appl. No. 16/448,388, filed Jun. 21, 2019, entitled "Thermal Management Systems."
U.S. Appl. No. 16/448,196, filed Jun. 21, 2019, entitled "Thermal Management Systems."
U.S. Appl. No. 16/666,851, filed Oct. 29, 2019, Davis et al.
U.S. Appl. No. 16/666,859, filed Oct. 29, 2019, Davis et al.
U.S. Appl. No. 16/666,865, filed Oct. 29, 2019, Davis et al.
U.S. Appl. No. 16/666,881, filed Oct. 29, 2019, Davis et al.
U.S. Appl. No. 16/666,899, filed Oct. 29, 2019, Davis et al.
U.S. Appl. No. 16/666,940, filed Oct. 29, 2019, Vaisman et al.
U.S. Appl. No. 16/666,950, filed Oct. 29, 2019, Vaisman et al.
U.S. Appl. No. 16/666,959, filed Oct. 29, 2019, Vaisman et al.
U.S. Appl. No. 16/666,962, filed Oct. 29, 2019, Vaisman et al.
U.S. Appl. No. 16/666,966, filed Oct. 29, 2019, Vaisman et al.
U.S. Appl. No. 16/666,973, filed Oct. 29, 2019, Vaisman et al.
U.S. Appl. No. 16/666,977, filed Oct. 29, 2019, Vaisman et al.
U.S. Appl. No. 16/666,986, filed Oct. 29, 2019, Vaisman et al.
U.S. Appl. No. 16/666,992, filed Oct. 29, 2019, Vaisman et al.
U.S. Appl. No. 16/666,995, filed Oct. 29, 2019, Vaisman et al.
U.S. Appl. No. 16/684,775, filed Nov. 15, 2019, Peters et al.
U.S. Appl. No. 16/807,340, filed Mar. 3, 2020, Vaisman.
U.S. Appl. No. 16/807,353, filed Mar. 3, 2020, Vaisman.
U.S. Appl. No. 16/807,411, filed Mar. 3, 2020, Vaisman.
U.S. Appl. No. 16/807,413, filed Mar. 3, 2020, Vaisman.
U.S. Appl. No. 16/807,582, filed Mar. 3, 2020, Vaisman.
U.S. Appl. No. 16/872,584, filed May 12, 2020, Vaisman et al.
U.S. Appl. No. 16/872,590, filed May 12, 2020, Vaisman et al.

(56) References Cited

OTHER PUBLICATIONS

U.S. Appl. No. 16/872,592, filed May 12, 2020, Vaisman et al.
NASA History Office, "Quest for Performance: The Evolution of Modern Aircraft, Part II: The Jet Age, Chapter 10: Technology of the Jet Airplane, Turbojet and Turbofan Systems," NASA Scientific and Technical Information Branch, originally published in 1985, last updated Aug. 6, 2004, 21 pages.
[No Author Listed], "Thermostatic Expansion Valves" Theory of Operation, Application, and Selection, Bulletin 10-9, Sporlan, Mar. 2011, 19 pages.
ammonia21.com [online], "R717 vs r404a do the advantages outweigh the disadvantages," Nov. 30, 2012, retrieved from <http://www.annnnonia21.conn/articles/3717/>, 13 pages.
Elstroem, "Capacitive Sensors Measuring the Vapor Quality, Phase of the refrigerant and Ice thickness for Optimized evaporator performance," Proceedings of the 13th IIR Gustav Lorentzen Conference on Natural Refrigerants (GL:2018), Valencia, Spain, Jun. 18-20, 2018, 10 pages.
Elstroem, "New Refrigerant Quality Measurement and Demand Defrost Methods," 2017 IIAR Natural Refrigeration Conference & Heavy Equipment Expo, San Antonio, TX, Technical Paper #1, 38 pages.
en.wikipedia.org [online] "Inert gas—Wikipedia" retrieved on Oct. 1, 2021, retrieved from URL < https://en.wikipedia.org/w/index.php?title=Inert_gas&oldid=1047231716>, 4 pages.
en.wikipedia.org [online] "Pressure regulator—Wikipedia," retrieved on Oct. 7, 2021, retrieved from URL < https://en.wikipedia.org/wiki/Pressure_regulator>, 8 pages.
en.wikipedia.org [online], "Isenthalpic process—Wikipedia, the free encyclopedia," available on or before Mar. 29, 2015, via Internet Archive: Wayback Machine URL <https://web.archive.org/web/20150329105343/https://en.wikipedia.org/wiki/Isenthalpicprocess>, retrieved on Jan. 12, 2021, retrieved from URL <https://en.wikipedia.org/wiki/Isenthalpicprocess>, 2 pages.
en.wikipedia.org [online], "Thermal expansion valve—Wikipedia", Dec. 23, 2020, retrieved on Jan. 8, 2021, retrieved from URL <https://en.wikipedia.org/wiki/Thernnal expansion valve>, 4 pages.
en.wikipedia.org [online], "Thermal expansion valve—Wikipedia," available on or before Feb. 14, 2015, via Internet Archive: Wayback Machine URL <https://web.archive.org/web/20150214054154/https://en.wikipedia.org.wiki/Thermal_expansion_valve>, retrieved on Jan. 12, 2021, URL <https://en.wikipedia.org.wiki/Thermal expansion valve>, 3 pages.
engineersedge.com [online], "Throttling Process Thermodynamic," Apr. 16, 2015, via Internet Archive: Wayback Machine URL <https://web.archive.org/web/20150416181050/https://www.engineersedge.conn/thernnodynannics/throttling process.htm>, retrieved on Jan. 12, 2021, retrieved from URL <https://en.wikipedia.org/wiki/Isenthalpicprocess>, 1 pages.
International Search Report and Written Opinion in International Appln. No. PCT/US2020/056787, dated Jan. 27, 2021, 13 pages.
ohio.edu [online], "20 Engineering Thermodynamics Israel Urieli", Sep. 9, 2009, retrieved from URL< https://www.ohio.edu/mechanical/thermo/Intro/Chapt.1_6/Chapter2a.html>, 1 page.
osha.gov, [online] "Storage and handling of anhydrous ammonia," Part No. 1910, Standard No. 1910.111, GPO Source: e-CFR, 2005, retrieved on Oct. 2, 2021, retrieved from URL < https://www.osha.gov/laws-regs/regulations/standardnumber/1910/1910.111>, 31 pages.
thermal-engineering.org [online] "What is Vapor Quality—Dryness Fraction—Definition," May 22, 2019, retrieved on Oct. 19, 2021, retrieved from URL < https://www.thermal-engineering.org/what-is-vapor-quality-dryness-fraction-definition/>, 6 pages.
Wojtan et al., "Investigation of flow boiling in horizontal tubes: Part I—A new diabatic two-phase flow pattern map. International journal of heat and mass transfer," Jul. 2005, 48(14):2955-69.
Wojtan et al., "Investigation of flow boiling in horizontal tubes: Part II—Development of a new heat transfer model for stratified-wavy, dryout and mist flow regimes," International journal of heat and mass transfer, Jul. 2005, 48(14):2970-85.

* cited by examiner

THERMAL MANAGEMENT SYSTEMS

CLAIM OF PRIORITY

This application claims priority under 35 USC § 119(e) to U.S. Provisional Patent Application Ser. No. 62/754,104, filed on Nov. 1, 2018, and entitled "THERMAL MANAGEMENT SYSTEMS," the entire contents of which are hereby incorporated by reference.

BACKGROUND

Refrigeration systems absorb thermal energy from the heat sources operating at temperatures below the temperature of the surrounding environment, and discharge thermal energy into the surrounding environment. Conventional refrigeration systems can include at least a compressor, a heat rejection exchanger (i.e., a condenser), a liquid refrigerant receiver, an expansion device, and a heat absorption exchanger (i.e., an evaporator). Such systems are closed circuit systems and can be used to maintain operating temperature set points for a wide variety of cooled heat sources (loads, processes, equipment, systems) thermally interacting with the evaporator. Closed-circuit refrigeration systems may pump significant amounts of absorbed thermal energy from heat sources into the surrounding environment.

However, condensers and compressors can be heavy and can consume relatively large amounts of power. In general, the larger the amount of absorbed thermal energy that the system is designed to handle, the heavier the refrigeration system and the larger the amount of power consumed during operation, even when cooling of a heat source occurs over relatively short time periods.

SUMMARY

This disclosure features thermal management systems that include open circuit refrigeration systems (OCRSs) with an evaporator at a low pressure side of an ejector. Open circuit refrigeration systems generally include a liquid refrigerant receiver, an expansion device, and a heat absorption exchanger (i.e., an evaporator). The receiver stores liquid refrigerant which is used to cool heat loads. Typically, the longer the desired period of operation of an open circuit refrigeration system, the larger the receiver and the charge of refrigerant fluid contained within it. OCRSs can be useful in many circumstances, especially in systems where dimensional and/or weight constraints are such that heavy compressors and condensers typical of closed circuit refrigeration systems are impractical, and/or power constraints make driving the components of closed circuit refrigeration systems infeasible.

According to an aspect, a thermal management system includes an open circuit refrigeration circuit that has a refrigerant fluid flow path. The refrigerant fluid flow path includes a receiver configured to store a refrigerant fluid, a recuperative heat exchanger that has a first fluid path that receives the refrigerant fluid from the receiver and a second fluid path that provides thermal contact between refrigerant leaving the receiver through an outlet and refrigerant vapor passed into the recuperative heat exchanger. The refrigerant fluid flow path also includes an ejector having a primary flow inlet configured to receive the refrigerant fluid from the recuperative heat exchanger and a liquid separator that receives refrigerant fluid at an inlet. The liquid separator provides at a first outlet, the refrigerant vapor, and provides at a second outlet, refrigerant liquid. The refrigerant fluid flow path also includes an evaporator configured to extract heat from a heat load that contacts the evaporator, with the evaporator coupled to the ejector and the liquid separator, and an exhaust line.

Aspects also include methods and computer program products to control thermal management system with an open circuit refrigerant system.

One or more of the above aspects may include amongst features described herein one or more of the following features.

The receiver is a first receiver, and the system further includes a second receiver configured to store a gas to feed the first receiver. The ejector further has a secondary inlet and the secondary inlet of the ejector is coupled the second outlet of the liquid separator. The recuperative heat exchanger reduces liquid refrigerant mass flow rate demand from the receiver. The recuperative heat exchanger re-uses enthalpy of the exhaust vapor to precool the refrigerant liquid entering the evaporator to reduce the enthalpy of the refrigerant entering the evaporator to reduce mass flow rate demand of the system. The ejector includes a motive nozzle that receives a primary flow from the first receiver, a secondary nozzle that receives a secondary flow, a mixing region that receives and mixes the primary flow and the secondary flow to produce a mixed flow, and a diffuser that receives the mixed flow and diffuses the mixed flow and delivers the diffused mixed flow at an outlet of the ejector.

The system further includes a first control device configurable to control a vapor quality of the refrigerant fluid at an outlet of the evaporator along the refrigerant fluid flow path. The system further includes a first control device configurable to control a flow of the gas from the first receiver to the second receiver to regulate a vapor pressure in the second receiver. The system further includes a first control device configured to control a flow of the gas from the second receiver to the first receiver to regulate a vapor pressure in the first receiver, and a second control device configured to control a flow of the refrigerant fluid from the recuperative heat exchanger through the evaporator. The system further includes a first control device configured to control a flow of the gas from the second receiver to the first receiver to regulate a vapor pressure in the first receiver, a second control device configured to control a flow of the refrigerant fluid from the recuperative heat exchanger through the evaporator, a third control device configured to control upstream vapor pressure.

The recuperative heat exchanger further includes a helical-coil type heat exchanger that includes a shell and a helical coil inside the shell. The helical-coil type heat exchanger the refrigerant liquid stream from the receiver flows though the shell and the vapor stream from the vapor side of the liquid separator flows through the coil. Heat from the vapor stream is transferred from the vapor stream to the liquid stream. The first outlet of the liquid separator is a liquid side outlet that for the refrigerant receives substantially only liquid refrigerant from the liquid separator, and the second outlet is a vapor side outlet that receives substantially only vapor refrigerant from the liquid separator. The evaporator is coupled between an outlet of the ejector and an inlet of the liquid separator. The evaporator is coupled between the outlet of the ejector and the inlet of the liquid separator. The evaporator is coupled between the secondary inlet of the ejector and an outlet of the liquid separator. The evaporator is a first evaporator and the heat load is a first heat load, and the first evaporator is coupled between the secondary inlet of the ejector and an outlet of the liquid separator, with the system further including a second evaporator configured to extract heat from a second heat load that contacts the second evaporator, with the second evaporator having an inlet coupled to outlet of the liquid separator and the second evaporator having an outlet coupled to the secondary inlet of the ejector.

The evaporator is a first evaporator and the first evaporator is coupled between the secondary inlet of the ejector and an outlet of the liquid separator, with the system further including a second evaporator with the second evaporator having an inlet coupled to outlet of the liquid separator and the second evaporator having an outlet coupled to the secondary inlet of the ejector, and a third evaporator configured to extract heat from a third heat load that contacts the third evaporator, the third evaporator having an inlet that is coupled to a liquid side outlet of the liquid separator. The system further includes a back pressure regulator configured to receive refrigerant vapor that exits the recuperative heat exchanger after contacting the refrigerant and that is coupled to the exhaust line that exhausts refrigerant vapor. For the given set of operating conditions the vapor quality of the refrigerant at the outlet of the evaporator is within a range of 0.6 to 0.95 of vapor to liquid.

The system further includes a control device configurable to control a flow of the gas from the first receiver to the second receiver to regulate a vapor pressure in the second receiver, an expansion device coupled between an inlet to the evaporator and the first outlet of the liquid separator, configurable to control the vapor quality of the refrigerant fluid emerging from evaporator, and with the control device, the expansion device, the first receiver, the second receiver, the evaporator, the liquid separator, and the exhaust line providing the refrigerant fluid flow path. The recuperative heat exchanger has a vapor outlet in the second path, which is coupled to the back pressure regulator. The system further includes one or more sensor devices to produce one or more signals that are one or more measures thermodynamic properties of the refrigerant fluid. The first receiver is configured to store ammonia, and the second receiver is configured to store nitrogen or another inert gas.

One or more of the above aspects may include one or more of the following advantages.

The open circuit refrigeration system embodiments described herein include an ejector and a liquid separator. The open circuit refrigeration system with ejector (OCRSE) includes two downstream circuits from the liquid separator. One downstream circuit carries a liquid and includes an expansion device, the evaporator that extracts heat from a heat load when the heat load contacts the evaporator, and a low-pressure inlet to the ejector. The other downstream circuit carries vapor from the liquid separator and includes an exhaust line. The OCRSE system has a first control device configured to control temperature of the heat load and a second control device configured to control refrigerant flow through a motive nozzle of the ejector, via pressure in the refrigerant receiver.

The open circuit refrigeration systems disclosed herein use a mixture of two different phases (e.g., liquid and vapor) of a refrigerant fluid to extract heat energy from a heat load. In particular, for high heat flux loads that are to be maintained within a relatively narrow range of temperatures, heat energy absorbed from the high heat flux load can be used to drive a liquid-to-vapor phase transition in the refrigerant fluid, which transition occurs at a constant temperature. As a result, the temperature of the high heat flux load can be stabilized to within a relatively narrow range of temperatures. Such temperature stabilization can be particularly important for heat-sensitive high flux loads such as electronic components and devices that can be easily damaged via excess heating. Refrigerant fluid emerging from the evaporator can be used for cooling of secondary heat loads that permit less stringent temperature regulation than those electronic components that require regulation within a narrow temperature range.

The use of and ejector and a liquid separator in the disclosed configurations effective has the ejector acting as a "pump," to "pump" a secondary fluid flow, e.g., principally liquid from the liquid separator using energy of a primary refrigerant flow from a refrigerant receiver. By recirculation of refrigerant in a liquid phase, in effect increases the amount of refrigerant in the receiver in comparison to approaches in which the liquid from the liquid/vapor phase of refrigerant exits the evaporator is released.

The recuperative heat exchanger provides thermal contact between liquid refrigerant leaving the refrigerant receiver and refrigerant vapor from the liquid separator. The use of the recuperative heat exchanger at the outlet of the refrigerant receiver may reduce liquid refrigerant mass flow rate demand from the refrigerant receiver by re-using the enthalpy of the exhaust vapor to precool the refrigerant liquid entering the evaporator, which reduces the enthalpy of the refrigerant entering the evaporator, and thus reduces mass flow rate demand and providing a relative increase in energy efficiency of the system. The recuperative heat exchanger can be used in various configurations of the open circuit refrigeration system with ejector.

The open circuit refrigeration systems disclosed herein have a number of other advantages as disclosed below. Embodiments of the systems can also include any of the other features disclosed herein, including any combinations of individual features discussed in connection with different embodiments, except where expressly stated otherwise. Other features and advantages will be apparent from the description, drawings, and claims.

DETAILED DESCRIPTION

I. General Introduction

Cooling of high heat flux loads that are also highly temperature sensitive can present a number of challenges. On one hand, such loads generate significant quantities of heat that is extracted during cooling. In conventional closed-cycle refrigeration systems, cooling high heat flux loads typically involves circulating refrigerant fluid at a relatively high mass flow rate. However, closed-cycle system components that are used for refrigerant fluid circulation—including compressors and condensers—are typically heavy and consume significant power. As a result, many closed-cycle systems are not well suited for deployment in mobile platforms—such as on small vehicles—where size and weight constraints may make the use of large compressors and condensers impractical.

On the other hand, temperature sensitive loads such as electronic components and devices may require temperature regulation within a relatively narrow range of operating temperatures. Maintaining the temperature of such a load to within a small tolerance of a temperature "set point," i.e., a desired temperature value, can be challenging when a single-phase refrigerant fluid is used for heat extraction, since the refrigerant fluid itself will increase in temperature as heat is absorbed from the load.

Directed energy systems that are mounted to mobile vehicles such as trucks may present many of the foregoing operating challenges, as such systems may include high heat flux, temperature sensitive components that require precise cooling during operation in a relatively short time. The thermal management systems disclosed herein, while generally applicable to the cooling of a wide variety of thermal loads, are particularly well suited for operation with such directed energy systems.

In particular, the thermal management systems and methods disclosed herein include a number of features that reduce both overall size and weight relative to conventional refrigeration systems, and still extract excess heat energy from both high heat flux, highly temperature sensitive components and relatively temperature insensitive components, to accurately match temperature set points for the components. At the same time the disclosed thermal management systems require no significant power to sustain their operation. Whereas certain conventional refrigeration systems used closed-circuit refrigerant flow paths, the systems and methods disclosed herein use open-cycle refrigerant flow paths. Depending upon the nature of the refrigerant fluid, exhaust refrigerant fluid may be incinerated as fuel, chemically treated, and/or simply discharged at the end of the flow path.

II. Thermal Management Systems with Open Circuit Refrigeration Systems

Figure 1:
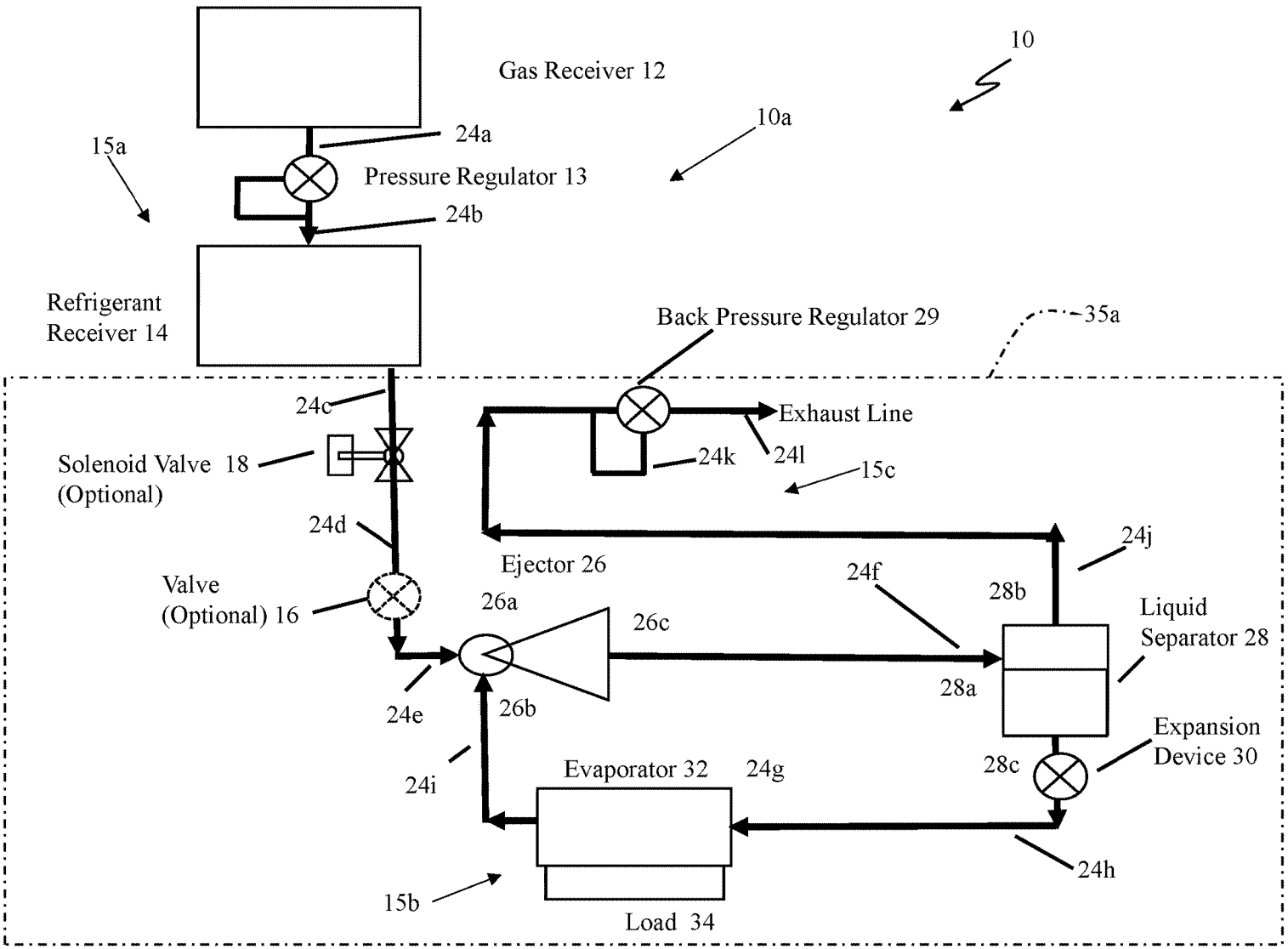
FIG. 1 is a schematic diagram of an example of a thermal management system that includes an open circuit refrigeration with ejector (OCRSE).

Referring now to FIG. 1, a thermal management system 10 includes an open circuit refrigeration system with ejector (OCRSE) that has a refrigerant fluid flow path 15*a*. In FIG. 1, an embodiment 10*a* the OCRSE is shown. OCRSE 10*a* is one of several open circuit refrigeration with ejector 10*a*-10*g* system configurations that will be discussed herein. Also discussed below will be an OCRSE 11*a* system configuration that is one of several open circuit refrigeration with ejector system configurations that include one receiver, but which otherwise parallel OCRSE configurations 10*a*-10*g*.

OCRSE 10*a* includes an optional first receiver 12 that receives and is configured to store a gas, an optional control device 13, e.g., an expansion valve, which is upstream from a second receiver 14 that receives and is configured to store sub-cooled liquid refrigerant. The gas pressure supplied by the gas receiver 12 compresses the liquid refrigerant in the receiver 14 and maintains the liquid refrigerant in a sub-cooled state (e.g., as a liquid existing at a temperature below its normal boiling point temperature) even at high ambient and liquid refrigerant temperatures. OCRSE 10*a* also may include an optional valve 16 and an optional first control device, such as, a solenoid control valve 18. Both, either or neither of the optional valve 16 and the optional solenoid control valve 18 are used (i.e., or not used) in each of the embodiments of an OCRSE, as will be described in FIGS. 1, 3-8. In addition, a portion 35*a* of the OCRSE 10*a* is demarked by a phantom box, which will be used in the discussion of FIG. 9A.

The OCRSE 10*a* also includes an ejector 26. The ejector 26 has a primary inlet or high pressure inlet 26*a* that is coupled to the second receiver 14 (either directly or through the optional valve 16 and/or solenoid valve 18). In OCRSE 10*a*, outlet 26*c* of the ejector 26 is coupled to an inlet 28*a* of a liquid separator 28. The ejector 26 also has a secondary inlet or low pressure inlet 26*b*. The liquid separator 28 in addition to the inlet 28*a*, has a first outlet (vapor side outlet) 28*b* and a second outlet 28*c* (liquid side outlet). The first outlet 28*b* of the liquid separator 28 is coupled to an inlet (not referenced) of a back pressure regulator 29 and the back pressure regulator 29 has an outlet (not referenced) that feeds an Exhaust Line (not referenced).

The OCRSE 10*a* also includes an optional expansion device 30 and an evaporator 32. The evaporator 32 is coupled to the ejector 26 and the second outlet 28*c* (liquid/vapor side) of the liquid separator 28. The thermal management system 10 includes a thermal load 34 that is coupled to OCRSE 10*a* in thermal communication with the evaporator 32. The evaporator 32 is configured to extract heat from the thermal load 34 that is in contact with the evaporator 32. Conduits 24*a*-24*m* couple the various aforementioned items, as shown.

The OCRSE 10*a* can be viewed as including three circuits. A first circuit 15*a* being the refrigerant flow path 15*a* that includes the receivers 12 and 14 and two downstream circuits 15*b* and 15*c* that are downstream from the liquid separator 28. Downstream circuit 15*b* carries liquid from the liquid separator 28 and includes the expansion device 30 that feeds the evaporator 32. The downstream circuit 15*c* includes the back pressure regulator 29, and the exhaust line which exhausts refrigerant vapor.

Receivers 12, 14 are typically implemented as insulated vessels that store gas and refrigerant fluid, respectively, at relatively high pressures. In FIG. 1, the control device 13 is configurable to control a flow of the gas from the first receiver 12 to the second receiver 14 to regulate pressure in the second receiver 14 and control refrigerant flow from the second receiver 14. The control device can be a pressure regulator that regulates a pressure at an outlet of the pressure regulator 13.

Pressure regulator 13 generally functions to control the gas pressure from gas receiver 12 that is upstream of the refrigerant receiver 14. Transporting a gas from the gas receiver 12 into the refrigerant receiver 14 through pressure regulator 13, either prior to or during transporting of the refrigerant fluid from the refrigerant receiver 14, functions to control pressure in the refrigerant receiver 14 and the refrigerant fluid pressure upstream from the evaporator 32, especially when the optional valves 16 and 18 are not used. Pressure regulator 13 would be used at the outlet of the first receiver 12 to regulate pressure in the second receiver 14. For example, the pressure regulator 13 could start in a closed position, and as refrigerant pressure in the second receiver 14 drops the pressure regulator 13 can be control to start opening to allow gas from the first receiver 12 to flow into the second receiver 14 to substantially maintain a desired pressure in the second receiver 14 and thus provide a certain subcooling of the refrigerant in the receiver 12, and a certain refrigerant mass flow rate through the ejector 26, and evaporator 32, and, as a result, a desired cooling capacity for one or more thermal loads 34.

In general, pressure regulator 13 can be implemented using a variety of different mechanical and electronic devices. Typically, for example, pressure regulator 13 can be implemented as a flow regulation device that will match an output pressure to a desired output pressure setting value. In general, a wide range of different mechanical and electrical/electronic devices can be used as pressure regulator 13. Typically, a mechanical pressure regulator includes a restricting element, a loading element, and a measuring element. The restricting element is a valve that can provide a variable restriction to the flow. The loading element, e.g., a weight, a spring, a piston actuator, etc., applies a needed force to the restricting element. The measuring element functions to determine when the inlet flow is equal to the outlet flow.

Examples of suitable commercially available downstream pressure regulators that can function as control device 13 include, but are not limited to, regulators available from Emerson Electric (https://www.emerson.com/documents/automation/regulators-mini-catalog-en-125484.pdf).

In some embodiments, refrigerant flow through the OCRSE 10*a* is controlled either solely by the ejector 26 and back pressure regulator 29 or by those components aided by either one or all of the solenoid valve 18 and valve 16, pressure regulator 13, expansion device 30, depending on requirements of the application, e.g., ranges of mass flow rates, cooling requirements, receiver capacity, ambient temperatures, thermal load, etc.

In other embodiments, receiver 12 and the control device 13 are not used, see FIG. 9. When the receiver 12 is not used to maintain pressure in the second receiver 14, refrigerant flow is controlled either solely by the ejector 26 and back pressure regulator 29 or by those components aided by either or both of the solenoid valve 18 and valve 16, and expansion device 30, and the control strategies of those controls depending on requirements of the application, e.g., mass flow rates, cooling requirements, receiver capacity, ambient temperatures, thermal load, etc.

While both control device 18 and valve 16 are not typically used, in some implementations either or both would be used and would function as a flow control device (s) to control refrigerant flow into the primary inlet 26*a* of the ejector 26. In some embodiments valve 16 can be integrated with the ejector 26. In OCRSE 10*a* (as well as the other embodiments discussed below) the optional valve 16 may be required under some circumstances where there are or can be significant changes in, e.g., an ambient temperature, which might impose additional control requirements on the OCRSE 10*a*.

In general, the control device 18 can be implemented as a solenoid control valve 18 or any one or more of a variety of different mechanical and/or electronic devices. A solenoid valve includes a solenoid that uses an electric current to generate a magnetic field to control a mechanism to regulates an opening in a valve to control fluid flow. The control device 18 is configurable to stop refrigerant flow as an on/off valve.

The back pressure regulator 29 at the vapor side outlet 28*b* of the liquid separator 28 generally functions to control the vapor pressure upstream of the back pressure regulator 29. In OCRSE 10*a*, the back pressure regulator 29 is a control device that controls the refrigerant fluid vapor pressure from the liquid separator 28, and indirectly controls evaporating pressure/temperature. In general, control device 29 can be implemented using a variety of different mechanical and electronic devices. Typically, for example, control device 29 can be implemented as a flow regulation device. The back pressure regulator 29 regulates fluid pressure upstream from the regulator, i.e., regulates the pressure at the inlet to the regulator 29 according to a set pressure point value.

For valve 16 a mechanical expansion valve or an electrically controlled expansion valve could be used. The expansion device 30 (and valve 16) can be a fixed orifice device. Alternatively the expansion valve 30 can be an electrically controlled expansion valve. Typical electrical expansion valves include an orifice, a moving seat, a motor or actuator that changes the position of the seat with respect to the orifice, a controller (see FIG. 13), and pressure and temperature sensors at the evaporator exit. For example, in some of the further embodiments discussed below, the controller can be used with electrical expansion valves to calculate a value of superheat for the expanded refrigerant fluid based on pressure and temperature measurements at the liquid separator exit. If the superheat is above a set-point value, the seat moves to increase the cross-sectional area and the refrigerant fluid volume and mass flow rates to match the superheat set-point value. If the superheat is below the set-point value the seat moves to decrease the cross-sectional area and the refrigerant fluid flow rate into the evaporator 32. As used herein superheat refers to the phenomenon that is any increase in temperature of a substance in a gas phase above the boiling point for that substance in its liquid phase.

Some loads require maintaining thermal contact between the load 34 and evaporator 32 with the refrigerant being in the two-phase region (of a phase diagram for the refrigerant) and, therefore, the expansion device or valve 30 maintains a proper vapor quality at the evaporator exit. Alternatively, a sensor communicating with a controller may monitor pressure in the refrigerant receiver 14, if the gas receiver 12 is not employed, as well as a pressure differential across the expansion valve 16, a pressure drop across the evaporator 32, a liquid level in the liquid separator 28, and power input into electrically actuated heat loads, or a combination of the above.

Examples of suitable commercially available expansion valves that can function as device 30 include, but are not limited to, thermostatic expansion valves available from the Sporlan Division of Parker Hannifin Corporation (Washington, Mo.) and from Danfoss (Syddanmark, Denmark).

Evaporator 32 can be implemented in a variety of ways. In general, evaporator 32 functions as a heat exchanger, providing thermal contact between the refrigerant fluid and heat load 34 that is coupled to the OCRSE 10*a*. Typically, evaporator 32 includes one or more flow channels extending internally between an inlet and an outlet of the evaporator, allowing refrigerant fluid to flow through the evaporator and absorb heat from heat load 34. A variety of different evaporators can be used in OCRSE 10*a*. In general, any cold plate may function as the evaporator of the open circuit refrigeration systems disclosed herein. Evaporator 32 can accommodate any number and type of refrigerant fluid channels (including mini/micro-channel tubes), blocks of printed circuit heat exchanging structures, or more generally, any heat exchanging structures that are used to transport single-phase or two-phase fluids. The evaporator 32 and/or components thereof, such as fluid transport channels, can be attached to the heat load mechanically, or can be welded, brazed, or bonded to the heat load in any manner.

In some embodiments, evaporator 32 (or certain components thereof) can be fabricated as part of heat load 34 or otherwise integrated into heat load 34.

The evaporator 32 can be implemented as plurality of evaporators connected in parallel and/or in series. The evaporator 32 can be coupled into a basic OCRSE system in a variety of ways to provide different embodiments of the OCRSE, with OCRSE 10*a* being a first example.

In FIG. 1, the evaporator 32 is coupled to the secondary inlet 26*b* (low-pressure inlet) of the ejector 26 and to an outlet of the expansion device 30, such that the expansion device and conduit 24*h* couple the evaporator 32 to the liquid side outlet of the liquid separator 28. In this configuration, the ejector 26 acts as a "pump," to "pump" a secondary fluid flow, e.g., liquid/vapor from the evaporator 32 using energy of the primary refrigerant flow from the refrigerant receiver 14.

Figure 2:
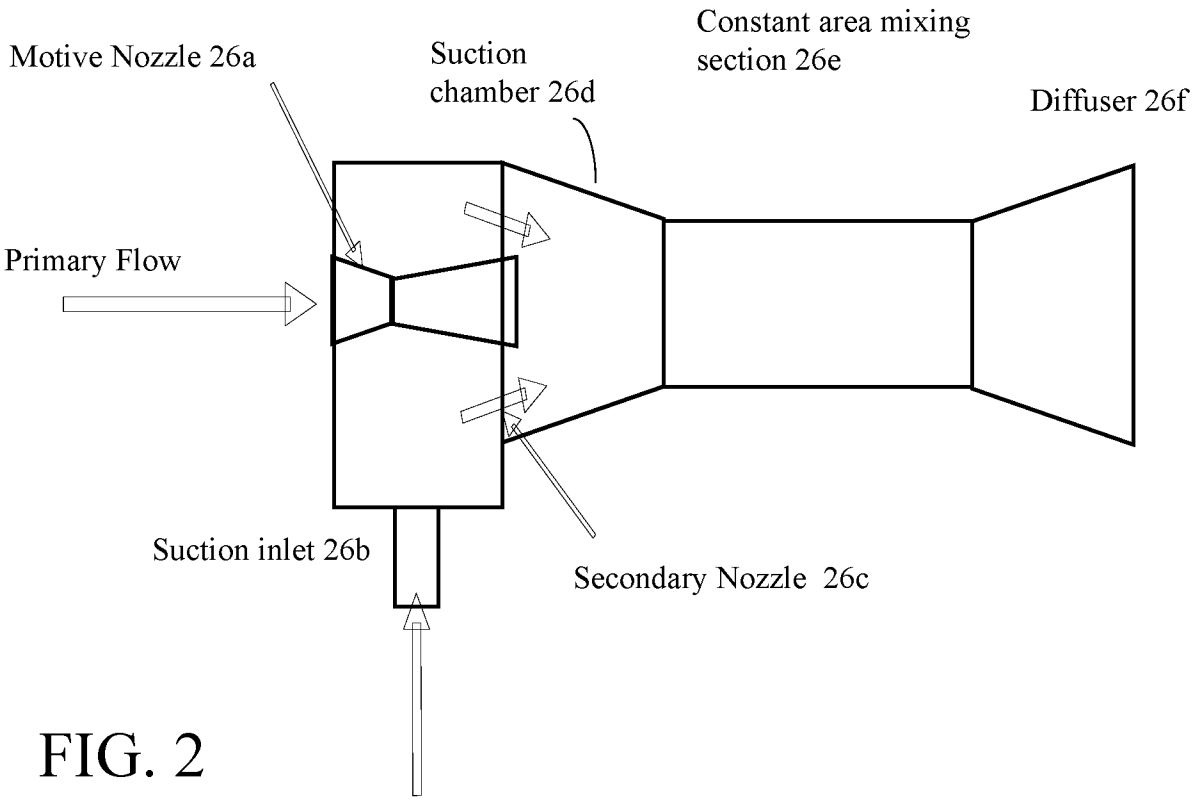
FIG. 2 is a schematic diagram of an ejector.

Referring now also to FIG. 2, a typical configuration for the ejector 26 is shown. This exemplary ejector 26 includes a motive nozzle 26*a*, a suction inlet 26*b*, a secondary nozzle 26*c* that feeds a suction chamber 26*d*, a mixing chamber 26*e* for the primary flow of refrigerant and secondary flow of refrigerant to mix, and a diffuser 26*f*. In one embodiment, the ejector 26 is passively controlled by built-in flow control. Also, the OCRSE 10*a* may employ the optional flow control device(s) 16, 18 upstream of the ejector 26.

Liquid refrigerant from the refrigerant receiver is the primary flow. In the motive nozzle 26*a* potential energy of the primary flow is converted into kinetic energy reducing the potential energy (the established static pressure) of the primary flow. The secondary flow from the outlet of the evaporator 32 has a pressure that is higher than the established static pressure in the suction chamber 26*b*, and thus the secondary flow is entrained through the suction inlet (secondary inlet) and the secondary nozzle(s) internal to the ejector 26. The two streams (primary flow and secondary flow) mix together in the mixing section 26*e*. In the diffuser section 26*f*, the kinetic energy of the mixed streams is converted into potential energy elevating the pressure of the mixed flow liquid/vapor refrigerant that leaves the ejector 26 and is fed to the liquid separator 28.

In the context of open circuit refrigeration systems, the use of the ejector 26 allows for recirculation of liquid refrigerant captured by the liquid separator 28 to increase the efficiency of the system 10. That is, by allowing for some recirculation of refrigerant, but without the need for a compressor or a condenser, as in a closed cycle refrigeration system, this recirculation reduces the required amount of refrigerant needed for a given amount of cooling over a given period of operation.

The evaporator 32 may be configured to maintain exit vapor quality below the critical vapor quality defined as "1." However, the higher the exit vapor quality the better it is for operation of the ejector 26. Vapor quality is the ratio of mass of vapor to mass of liquid+vapor and is generally kept in a range of approximately 0.5 to almost 1.0, more specifically 0.6 to 0.95; more specifically 0.75 to 0.9 more specifically 0.8 to 0.9 or more specifically about 0.8 to 0.85.

Vapor quality is the ratio of mass of vapor to mass of liquid+vapor and in the systems herein is generally kept in a range of approximately 0.5 to almost 1.0; more specifically 0.6 to 0.95; more specifically 0.75 to 0.9 more specifically 0.8 to 0.9 or more specifically about 0.8 to 0.85. "Vapor quality" is thus defined as mass of vapor/total mass (vapor+liquid). In this sense, vapor quality cannot exceed "1" or be equal to a value less than "0."

In practice vapor quality may be expressed as "equilibrium thermodynamic quality" that is calculated as follows:

$$X=(h-h')/(h''-h'),$$

where h—is specific enthalpy, specific entropy or specific volume, '—means saturated liquid and "—means saturated vapor. In this case X can be mathematically below 0 or above 1, unless the calculation process is forced to operate differently. Either approach for calculating vapor quality is acceptable.

Referring back to FIG. 1, the OCRSE 10*a* operates as follows. Gas from the gas receiver 12 is directed into the refrigerant (second) receiver 14. The gas is used to maintain an established pressure in the receiver 14. The liquid refrigerant from the receiver 14 (primary flow) is fed to the primary inlet of the ejector 26 and expands at a constant entropy in the ejector 26 (in ideal case; in reality the nozzle is characterized by the isentropic efficiency of the ejector) and turns into a two-phase (gas/liquid) state. The refrigerant in the two-phase state from the ejector 26 enters the liquid separator 28, with only or substantially only liquid exiting the liquid separator at outlet 28*c* (liquid side outlet) and only or substantially only vapor exiting the separator 28 at outlet 28*b* the (vapor side outlet). The liquid stream exiting at outlet 28*c* enters and is expanded in the expansion device 30 into a liquid/vapor stream that enters the evaporator 32. The expansion device 30 is configured to maintain suitable vapor quality at the evaporator exit (or a superheat if this is acceptable to operate the heat load) and related recirculation rate.

The evaporator 32 provides cooling duty and discharges the refrigerant in a two-phase state at relatively low exit vapor quality (low fraction of vapor to liquid, e.g., generally below 0.5) into the secondary inlet 26*b* of the ejector 26. The ejector 26 entrains the refrigerant flow exiting the evaporator 32 and combines it with the primary flow from the second receiver 14. Vapor exits from the vapor side outlet 28*b* of the liquid separator 28 and is exhausted by the exhaust line. The back pressure regulator 29, regulates the pressure upstream of the regulator 29 so as to maintain upstream refrigerant fluid pressure in OCRSE 10*a*.

Figure 3:
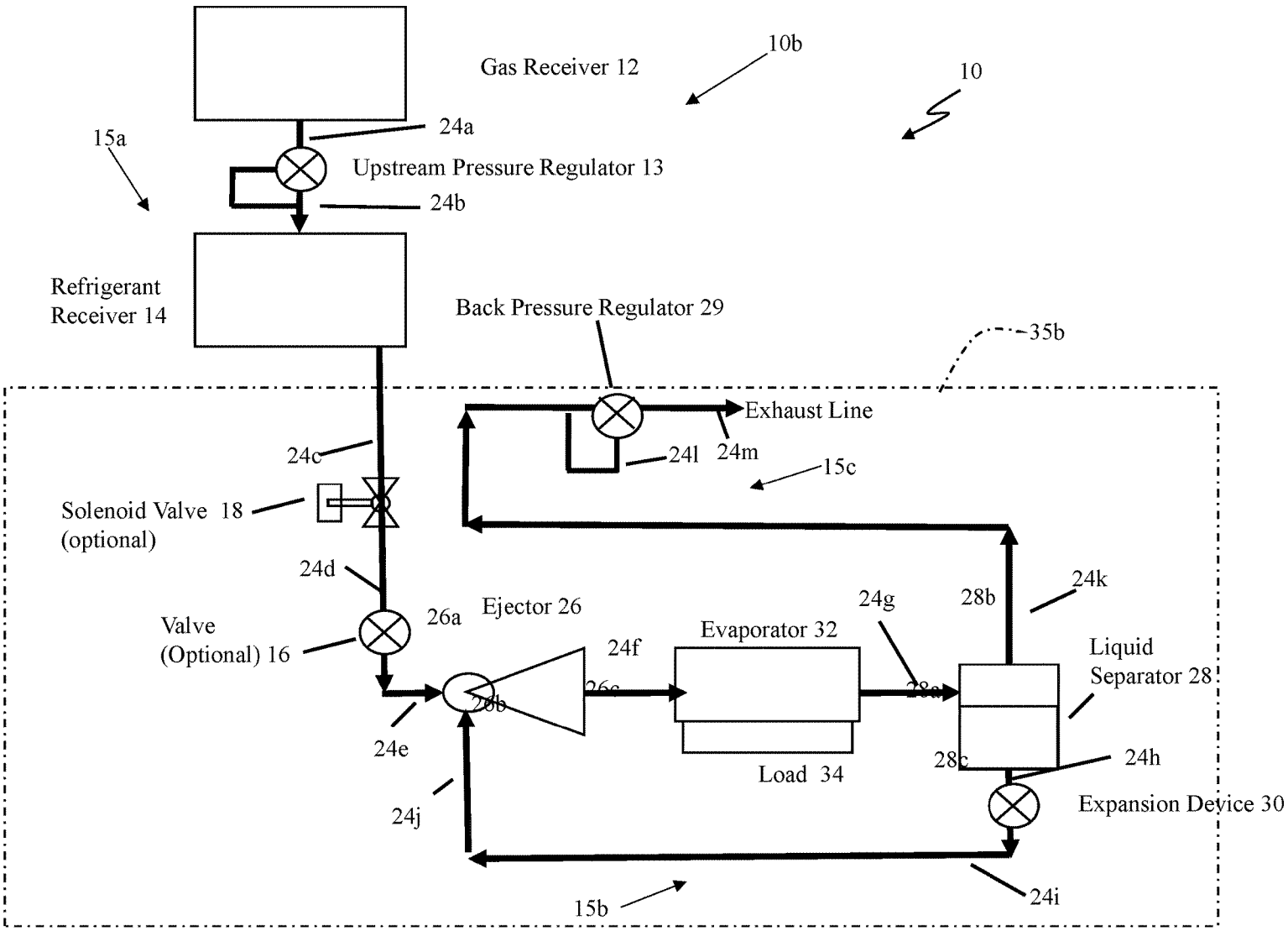
FIG. 3 is a schematic diagram of an alternative example of the OCRSE.

Referring now to FIG. 3, the system 10 includes an alternative open circuit refrigeration system with ejector (OCRSE) 10*b*. OCRSE 10*b* includes the first receiver 12, the pressure regulator 13 and the second receiver 14 as discussed for FIG. 1. OCRSE 10*b* also can include optional valve 16 and/or optional solenoid control valve 18, as discussed above. OCRSE 10*b* also includes the ejector 26 having the primary inlet 26*a* that is coupled to second receiver 14 directly (or through the valve 16 and solenoid control valve 18, if used) and having an outlet 26*c*.

In OCRSE 10*b*, the evaporator 32 inlet is coupled to the outlet 26*c* of the ejector 26 and the evaporator outlet is coupled to the inlet 28*a* of the liquid separator 28. The thermal load 34 is coupled to the evaporator 32. The evaporator 32 is configured to extract heat from the load 34 that is in contact with the evaporator 32. In OCRSE 10*b* the expansion device 30 is coupled between the liquid outlet 28*c* of the liquid separator 28 and the suction or secondary inlet 26*b* of the ejector 26. In addition, a portion 35*b* of the OCRSE 10*b* is demarked by a phantom box, which will be used in the discussion of FIG. 9C.

The second outlet (vapor side outlet) of the liquid separator 28 is coupled to the back pressure regulator 29 that is coupled to the Exhaust Line. Conduits 24*a*-24*m* couple the various aforementioned items as shown. With OCRSE 10*b*, the recirculation rate is equal to the vapor quality at the evaporator exit. The expansion device 30 is optional, and when used, is a fixed orifice device. The control valve 16 or other control device that is built in the motive nozzle of the ejector provides active control of the thermodynamic parameters of refrigerant state at the evaporator exit.

The OCRSE 10*b* operates as follows. Gas from the gas receiver 12 is directed into the refrigerant receiver 14. The gas is used to maintain an established pressure in the receiver 14, as discussed above. The liquid refrigerant from the receiver 14 is fed to the ejector 26 and expands at a constant entropy in the ejector 26 (in an ideal case; in reality the nozzle is characterized by the ejector isentropic efficiency), and turns into a two-phase (gas/liquid) state. The refrigerant in the two-phase state enters the evaporator 32 that provides cooling duty and discharges the refrigerant in a two-phase state at an exit vapor quality (fraction of vapor to liquid) below a unit vapor quality ("1"). The discharged refrigerant is fed to the inlet of the liquid separator 28, where the liquid separator 28 separates the discharge refrigerant with only or substantially only liquid exiting the liquid separator at outlet 28*c* (liquid side outlet) and only or substantially only vapor exiting the separator 28 at outlet 28*b* the (vapor side outlet). The vapor side may contain some liquid droplets since the liquid separator 28 has a separation efficiency below a "unit" separation. The liquid stream exiting at outlet 28*c* enters and is expanded in the optional expansion device 30, if used, into a liquid/vapor stream that enters the suction or secondary inlet of the ejector 26. The ejector 26 entrains the refrigerant flow exiting the expansion valve by the refrigerant from the receiver 14.

In OCRSE 10*b*, by placing the evaporator 32 between the outlet of the ejector 26 and the inlet of the liquid separator 28, OCRSE 10*b* avoids the necessity of having liquid refrigerant pass through the liquid separator 29 during the initial charging of the evaporator 32 with the liquid refrigerant, in contrast with the OCRSE 10*a* (FIG. 1). At the same time liquid trapped in the liquid separator may be wasted after the OCRSE shuts down.

The OCRSE 10*b* can also be viewed as including three circuits. The first circuit 15*a* being the refrigerant flow path as in FIG. 1 and two circuits 15*b*' and 15*c*. Circuit 15*b*' however is upstream from the liquid separator 28 and carries vapor/liquid from the evaporator 32 to the inlet to the liquid separator 28. The downstream circuit 15*c* exhausts vapor from liquid separator 28 via the back pressure regulator 29 to the Exhaust Line.

When a fixed orifice device is not used, the expansion valve 16 can be an electrically controlled expansion valve. Typical electrical expansion valves include an orifice, a moving seat, a motor or actuator that changes the position of the seat with respect to the orifice, a controller (see FIG. 13), and sensors. The sensors may monitor, vapor quality at the evaporator exit, pressure in the refrigerant receiver if the gas receiver is not employed, pressure differential across the expansion valve 16, pressure drop across the evaporator 32, liquid level in the liquid separator 28, power input into electrically actuated heat loads or a combination of the above.

Examples of suitable commercially available expansion valves that can function as device 30 include, but are not limited to, thermostatic expansion valves available from the Sporlan Division of Parker Hannifin Corporation (Washington, Mo.) and from Danfoss (Syddanmark, Denmark). Also, the expansion valve 16 can be integrated into the motive nozzle of the ejector.

Figure 4:
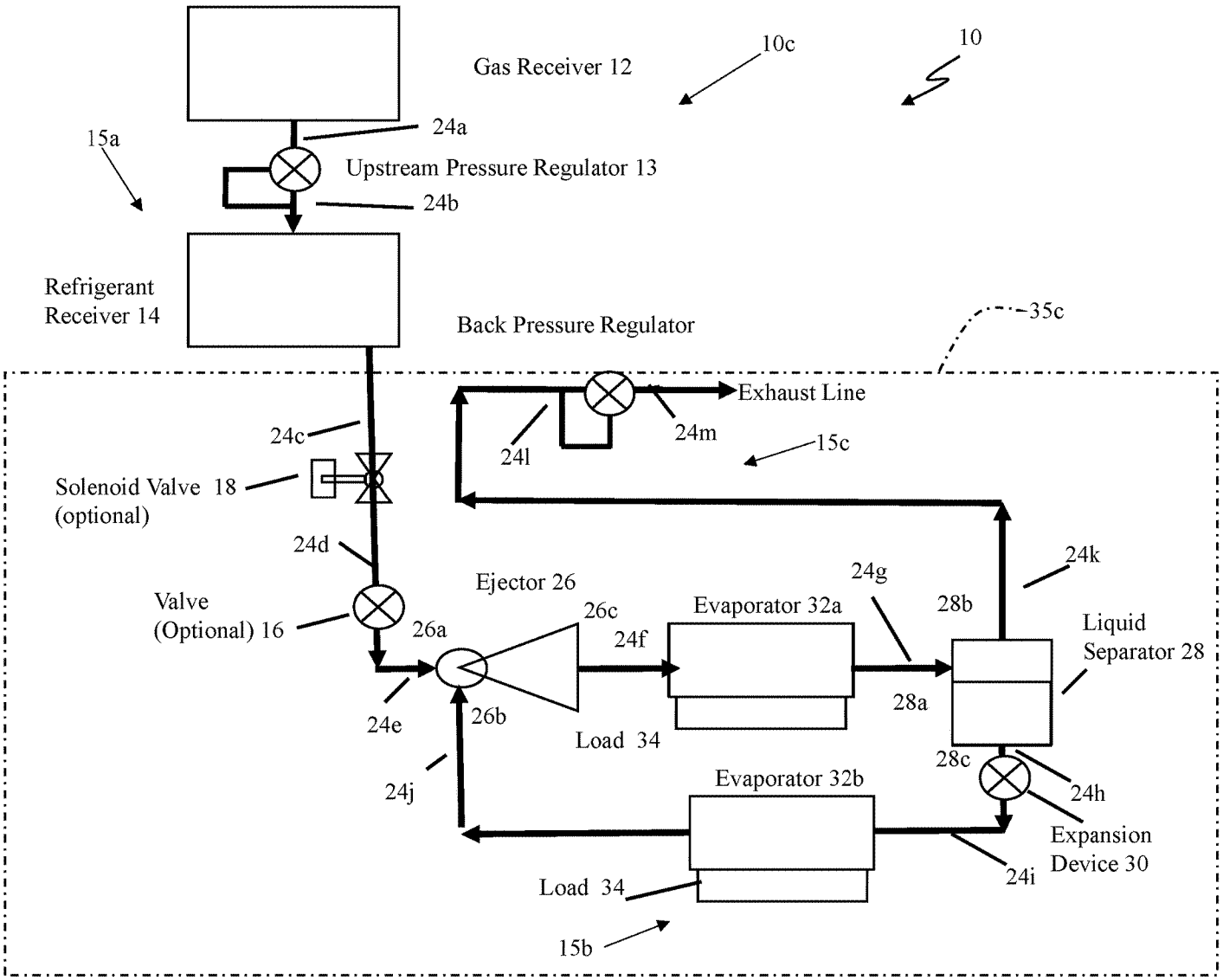
FIG. 4 is a schematic diagram of another alternative example of a thermal management system that includes OCRSE with two evaporators.

Referring now to FIG. 4, the system 10 includes another alternative open circuit refrigeration system with ejector (OCRSE) 10*c*. OCRSE 10*c* includes the first receiver 12, pressure regulator 13, and the second receiver 14 (optional valve 16 and optional solenoid control valve 18), coupled to inlet 26*a* of the ejector 26, and liquid separator 28. The OCRSE 10*c* includes the expansion device 30 coupled to the liquid side outlet 28*c* of the liquid separator 28. The second outlet 28*b* (vapor side outlet) of the liquid separator 28 is coupled via the back pressure regulator 29 to the exhaust line.

The OCRSE 10*c* also includes a first evaporator 32*a*. A thermal load 34*a* is coupled to the evaporator 32*a*. The evaporator 32*a* is configured to extract heat from the load 34*a* that is in contact with the evaporator 32*a*. The evaporator 32*a* is coupled to the outlet 26*c* of the ejector 26 and the inlet 28*a* of the liquid separator 28. The OCRSE 10*c* also includes a second evaporator 32*b* having an inlet coupled to the outlet of the expansion device 30, and the second evaporator 32*b* has an outlet coupled to the suction inlet 26*b* of the ejector 26. A thermal load 34*b* is coupled to the evaporator 32*b*. The evaporator 32*b* is configured to extract heat from the load 34*b* that is in contact with the evaporator 32*b*. Conduits 24*a*-24*m* couple the various aforementioned items, as shown. In addition, a portion 35*c* of the OCRSE 10*c* is demarked by a phantom box, which will be used in the discussion of FIG. 9C.

The cooling capacity of the OCRSE 10*a* is sensitive to recirculation rate. This configuration of FIG. 4, can operate with loads that allow for operation in superheated regions. The OCRSE 10*b* system is not sensitive to recirculation rate, which may be beneficial when the heat loads may significantly reduce recirculation rate. An operating advantage of the OCRSE 10*c* is that by placing evaporators 32*a*, 32*b* at both the outlet 26*c* and the secondary inlet 26*b* of the ejector 26, it is possible to run the evaporators 32*a*, 32*b* combining the features of the configurations mentioned above.

The OCRSE 10*c* can also be viewed as including three circuits. The first circuit 15*a* being the refrigerant flow path as in FIG. 1 and two circuits 15*b*" and 15*c*. Circuit 15*b*" being upstream and downstream from the liquid separator 28, carrying liquid from the liquid outlet of the liquid separator 28 and carrying vapor/liquid from the evaporator 32 into the inlet of the liquid separator 28. The downstream circuit 15*c* exhausts vapor via the back pressure regulator 29 to the Exhaust Line.

Figure 5:
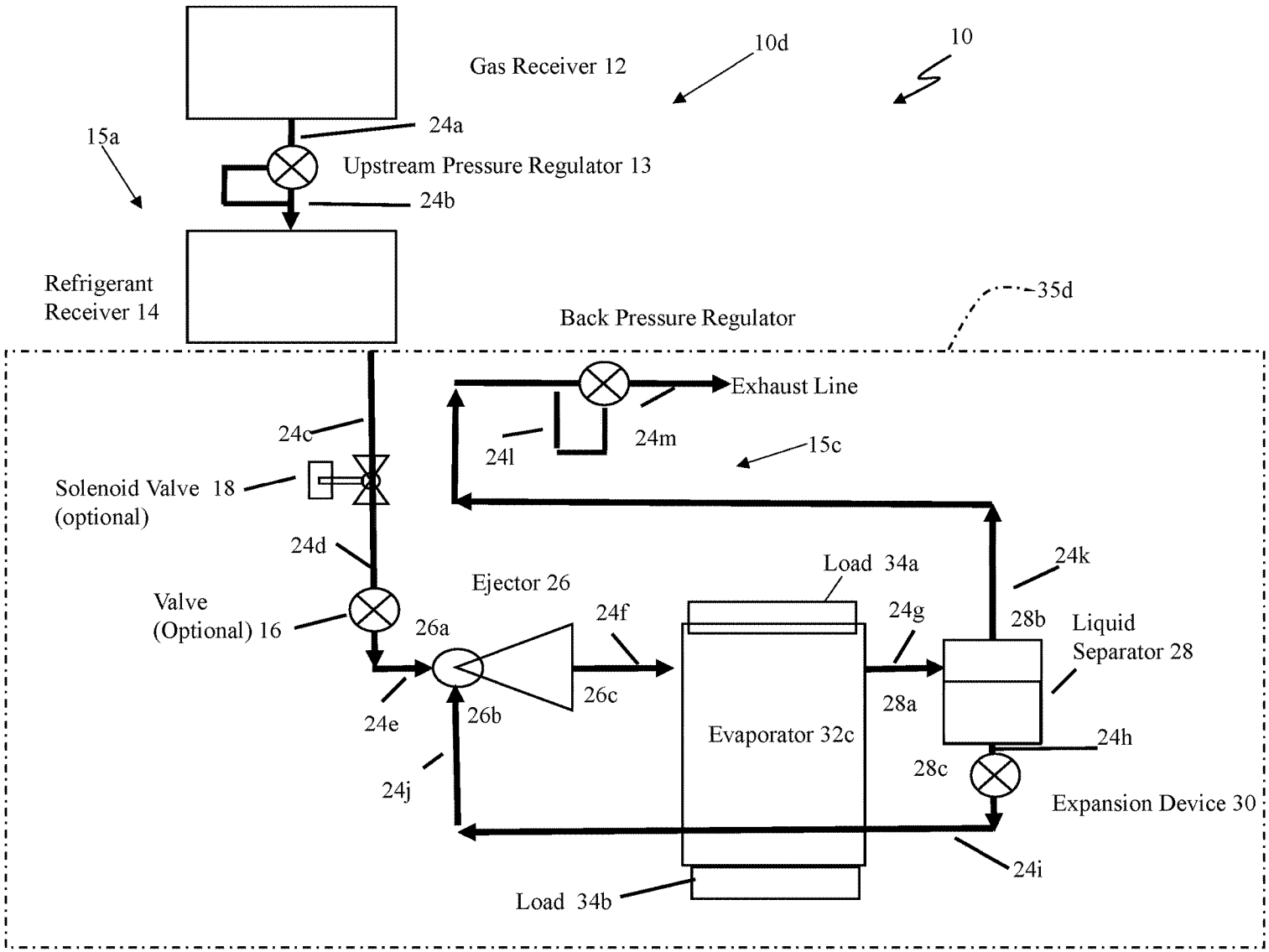
FIG. 5 is a schematic diagram of an example of the OCRSE with a single evaporator coupled upstream and downstream from the ejector.

Referring now to FIG. 5, the system 10 can include another alternative open circuit refrigeration system with ejector (OCRSE) 10*d*. OCRSE 10*d* includes the first receiver 12, the pressure regulator 13, and the second receiver 14 (optional valve 16 and optional solenoid control valve 18), ejector 26, and liquid separator 28, as discussed above. The OCRSE 10*d* includes the expansion device 30 coupled to the liquid side outlet 28*c* of the liquid separator 28.

The OCRSE 10*d* also includes a single evaporator 32*c* that is attached downstream from and upstream of the ejector 26. A first thermal load 34*a* is coupled to the evaporator 32*c*. The evaporator 32*c* is configured to extract heat from the first load 34*a* that is in contact with the evaporator 32*c*. A second thermal load 34*b* is also coupled to the evaporator 32*c*. The evaporator 32*c* is configured to extract heat from the second load 34*a* that is in contact with the evaporator 32*c*. The evaporator 32*c* has a first inlet that is coupled to the outlet 26*c* of the ejector 26 and a first outlet that is coupled to the inlet 28*a* of the liquid separator 28. The evaporator 32*c* has a second inlet that is coupled to the outlet of the expansion device 30 and has a second outlet that is coupled to the suction inlet 26*b* of the ejector 26. The second outlet 28*b* (liquid side outlet) of the liquid separator 28 is coupled via the back pressure regulator 29 to the exhaust line. Conduits 24*a*-24*m* couple the various aforementioned items, as shown. In addition, a portion 35*d* of the OCRSE 10*d* is demarked by a phantom box, which will be used in the discussion of FIG. 9D.

In this embodiment, the single evaporator 32*c* is attached downstream from and upstream of the ejector 26 and requires a single evaporator in comparison with the configuration of FIG. 4 having the two evaporators 32*a*, 32*b* (FIG. 4). The OCRSE 10*d* can also be viewed as including the three circuits 15*a*, 15*b*" and 15*c* as described in FIG. 5.

Figure 6:
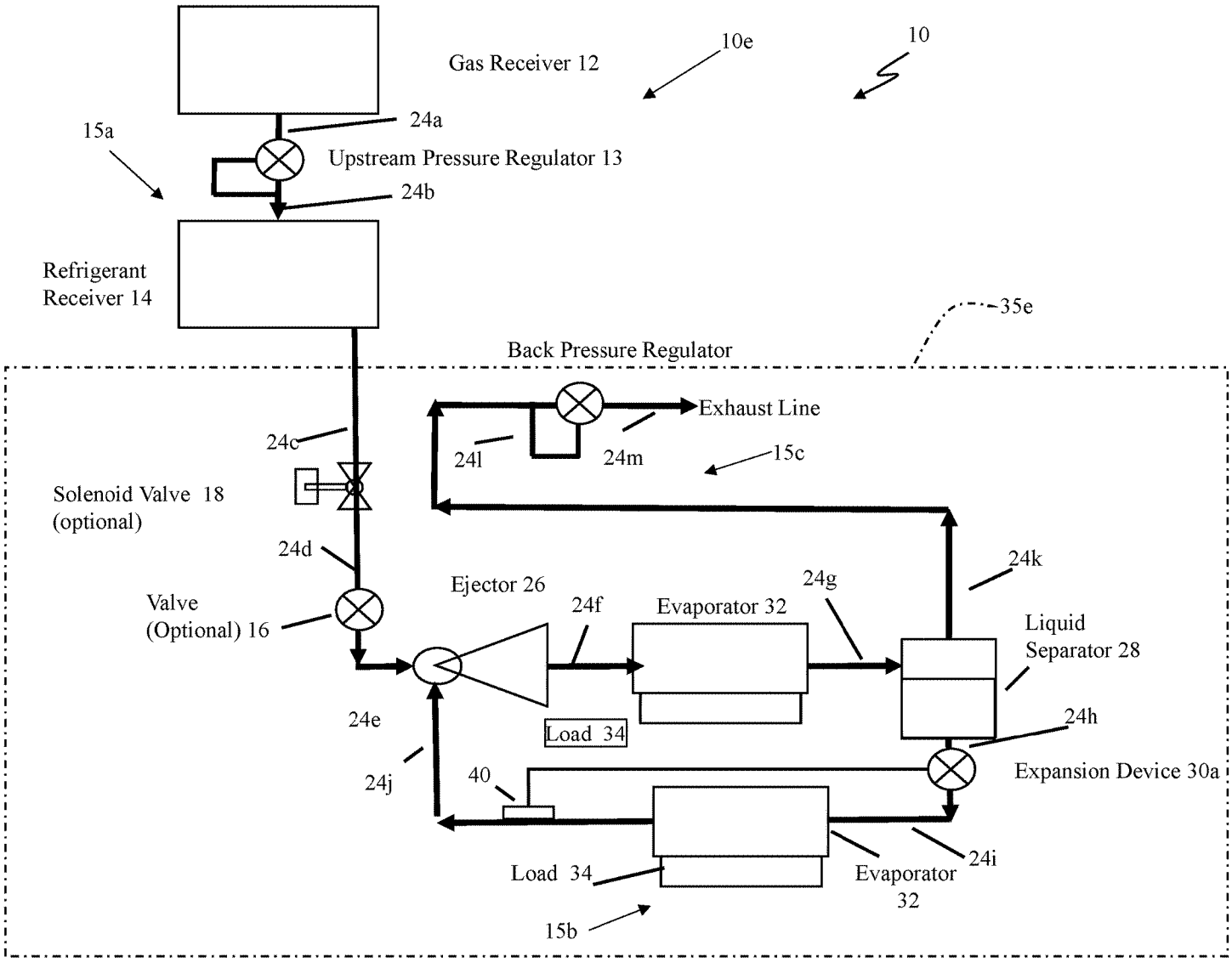
FIG. 6 is a schematic diagram of an example of the OCRSE with two evaporators and superheat control.

Referring now to FIG. 6, the system 10 includes an alternative open circuit refrigeration system with ejector (OCRSE) 10*e*. OCRSE 10*e* includes the first receiver 12, the pressure regulator 13, the second receiver 14 (optional valve 16 and optional solenoid control valve 18), ejector 26, liquid separator 28, and the evaporators 32*a*, 32*b*, as discussed in FIG. 4. The evaporators 32*a*, 32*b* have the first thermal load 34*a* and the second thermal load coupled to the evaporators 32*a*, 32*b* respectively, with the evaporators 32*a*, 32*b* configured to extract heat from the loads 34*a*, 34*b* in contact with the evaporators. Conduits 24*a*-24*m* couple the various aforementioned items, as shown. In addition, a portion 35*e* of the OCRSE 10*e* is demarked by a phantom box, which will be used in the discussion of FIG. 9E.

In this embodiment, the OCRSE 10*e* also includes an expansion device 30*a*. The expansion device 30*a* is a sensor controlled expansion device, such as an electrically controlled expansion valve. The evaporators 32*a*, 32*b* operate in two phase (liquid/gas) and superheated region with controlled superheat. OCRSE 10*e* includes a controllable expansion device 30*a* that is attached to the liquid side outlet 28*c* of the separator 28 and the evaporator 32 having a control port that is fed from a sensor 40. The sensor controlled expansion device 30*a* and sensor 40 provide a mechanism to measure and control superheat. The OCRSE 10*e* can also be viewed as including the three circuits 15*a*, 15*b*" and 15*c* as described in FIG. 5.

Figure 7:
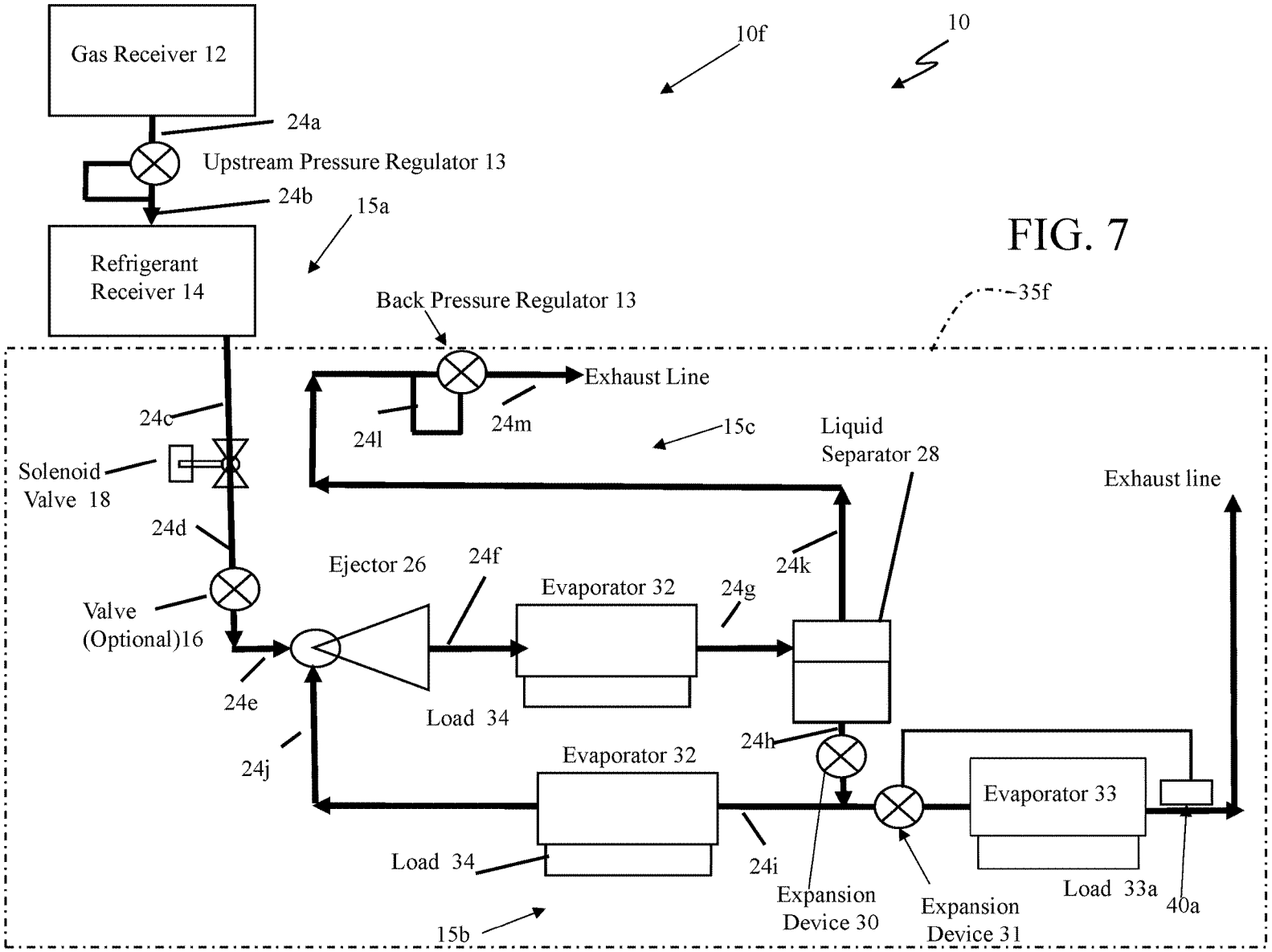
FIG. 7 is a schematic diagram of an example the OCRSE with two evaporators attached downstream from and upstream of the ejector, and with a third evaporator and dedicated expansion devices with superheat control.

Referring now to FIG. 7, the system 10 includes an alternative open circuit refrigeration system with ejector (OCRSE) 10*f*. OCRSE 10*f* includes the first receiver 12, the pressure regulator 13, the second receiver 14 (optional valve 16 and optional solenoid control valve 18), ejector 26, liquid separator 28, an expansion device 30 and the evaporators 32*a*, 32*b*, as discussed in FIG. 4, as well as, a second expansion device 31 and a second evaporator 33. The evaporators 32*a*, 32*b* have the first thermal load 34*a* and the second thermal load coupled to the evaporators 32*a*, 32*b* respectively, with the evaporators 32*a*, 32*b* configured to extract heat from the loads 34*a*, 34*b* in contact with the evaporators. A thermal load 33*a* is coupled to the evaporator 33 that is configured to extract heat from the load 33*a* in contact with the evaporator 33. The evaporator 33 is coupled to the expansion device 31 that is disposed between the outlet of expansion valve 30 and an inlet to the evaporator 33. Conduits 24*a*-24*m* couple the various aforementioned items, as shown in FIG. 4, and additional conduits (not referenced) couple the evaporator 33 to the expansion device 31 and a second Exhaust Line. In addition, a portion 35*f* of the OCRSE 10*f* is demarked by a phantom box, which will be used in the discussion of FIG. 9F.

The evaporators 32*a*, 32*b* operate in two phase (liquid/gas) and the third evaporator 33 operates in superheated region with controlled superheat. OCRSE 10*f* includes the controllable expansion device 31 that has an inlet attached to the outlet of expansion valve 30 and has an outlet attached to the evaporator 33. The expansion valve 31 has a control port that is fed from a sensor 40*a*. The sensor 40*a* controls the expansion valve 31 and provides a mechanism to measure and control superheat. The OCRSE 10*f* can also be viewed as including the three circuits 15*a*, 15*b*" and 15*c* as described in FIG. 5.

Figure 13:
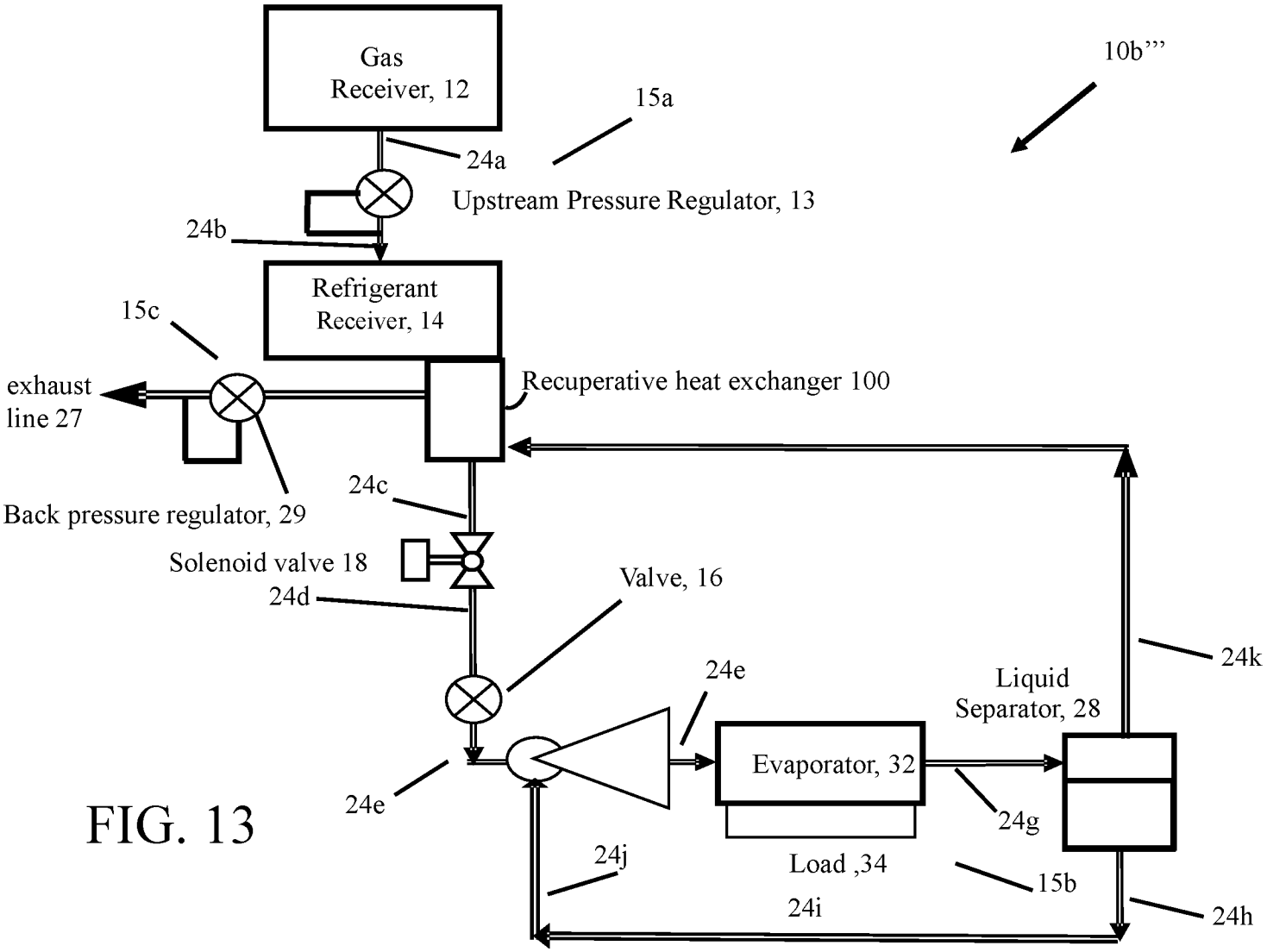
FIG. 13 is a schematic diagram of an example of the thermal management system that includes a recuperative heat exchanger.

In FIGS. 1 and 3-5, the vapor quality of the refrigerant fluid after passing through evaporator 32 can be controlled either directly or indirectly with respect to a vapor quality set point by a controller (not shown, see FIG. 13).

In some embodiments, as shown in FIGS. 6 and 7, the system 10 includes a sensor 40 or 40*a* that provides a measurement of superheat, and indirectly, vapor quality. For example, in FIG. 6, sensor 40 is a combination of temperature and pressure sensors that measure the refrigerant fluid superheat downstream from the heat load, and transmits the measurements to the controller (not shown). The controller adjusts the expansion valve device 30 based on the measured superheat relative to a superheat set point value. By doing so, controller indirectly adjusts the vapor quality of the refrigerant fluid emerging from evaporator 32.

Figure 8:
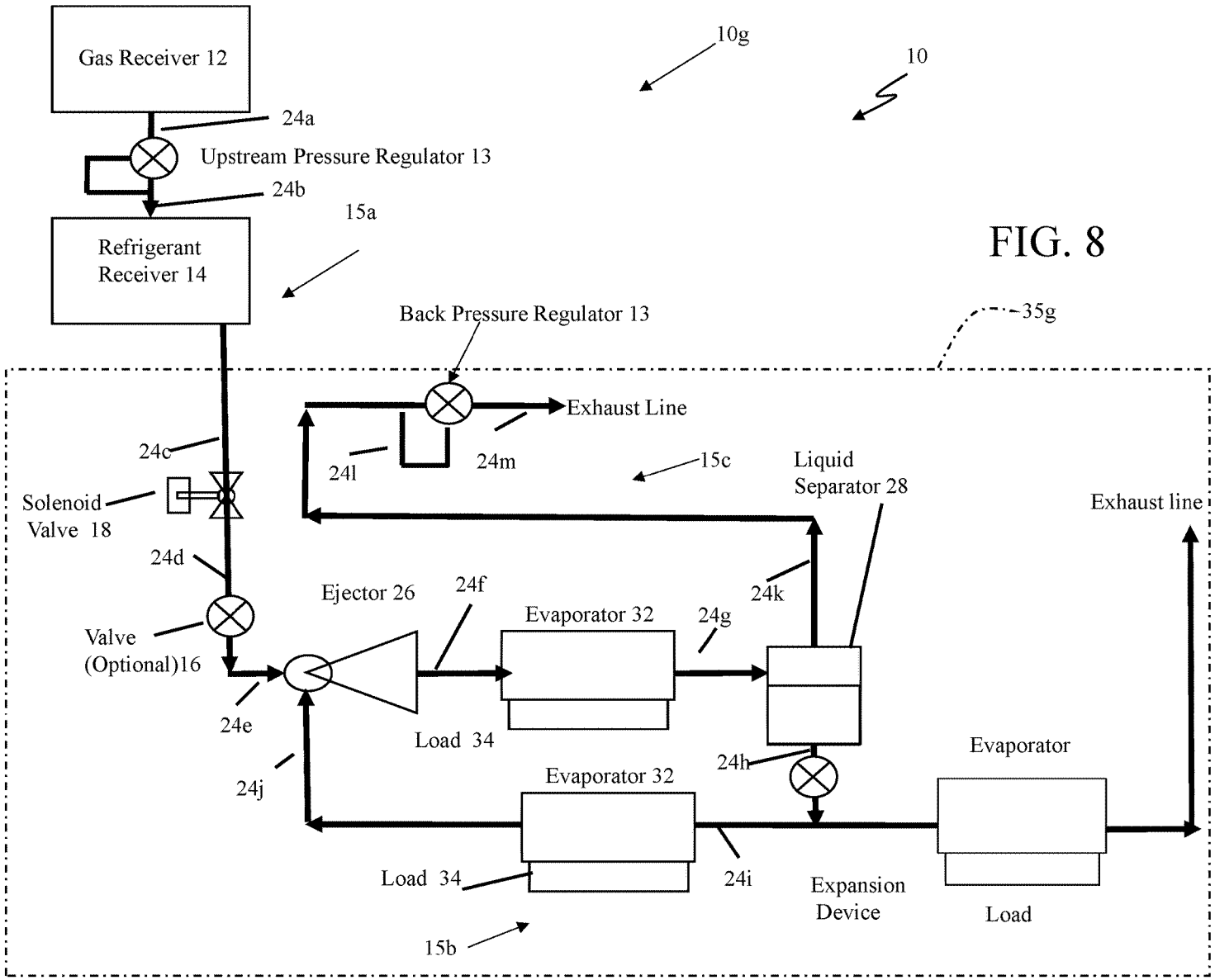
FIG. 8 is a schematic diagram of an example the OCRSE with two evaporators attached downstream from and upstream of the ejector and with a third evaporator that share a single expansion device.

Referring now to FIG. 8, the system 10 includes another alternative open circuit refrigeration system with ejector (OCRSE) 10*g*. OCRSE 10*g* includes the first receiver 12, the pressure regulator 13, the second receiver 14 (optional valve 16 and optional solenoid control valve 18), ejector 26, liquid separator 28, the expansion device 30 and the evaporators 32*a*, 32*b*, 33, and thermal load 34*a*, 34*b* and 33*a*, as discussed in FIG. 7, (but without the expansion valve 31 of FIG. 7). In this embodiment the OCRSE 10*g* includes the third evaporator 33 that shares the same expansion valve, i.e., expansion valve 30, as the evaporators 32*a*, 32*b*. The evaporators 32*a*, 32*b* operate in two phase (liquid/gas) and evaporator 33 operates in superheated region with controlled superheat. Conduits 24*a*-24*m* couple the various aforementioned items, as shown. Additional conduits (not referenced) couple the evaporator 33 to a second exhaust line and second back pressure regulator. In addition, a portion 35*g* of the OCRSE 10*g* is demarked by a phantom box, which will be used in the discussion of FIG. 9G.

The OCRSE 10*g* can also be viewed as including the three circuits 15*a*, 15*b*" and 15*c*, as described in FIG. 5.

FIGS. 9A to 9G show the system 10 with a different family of alternative open circuit refrigeration system with ejector (OCRSE) configurations 11*a*-11*g*.

Figure 9A:
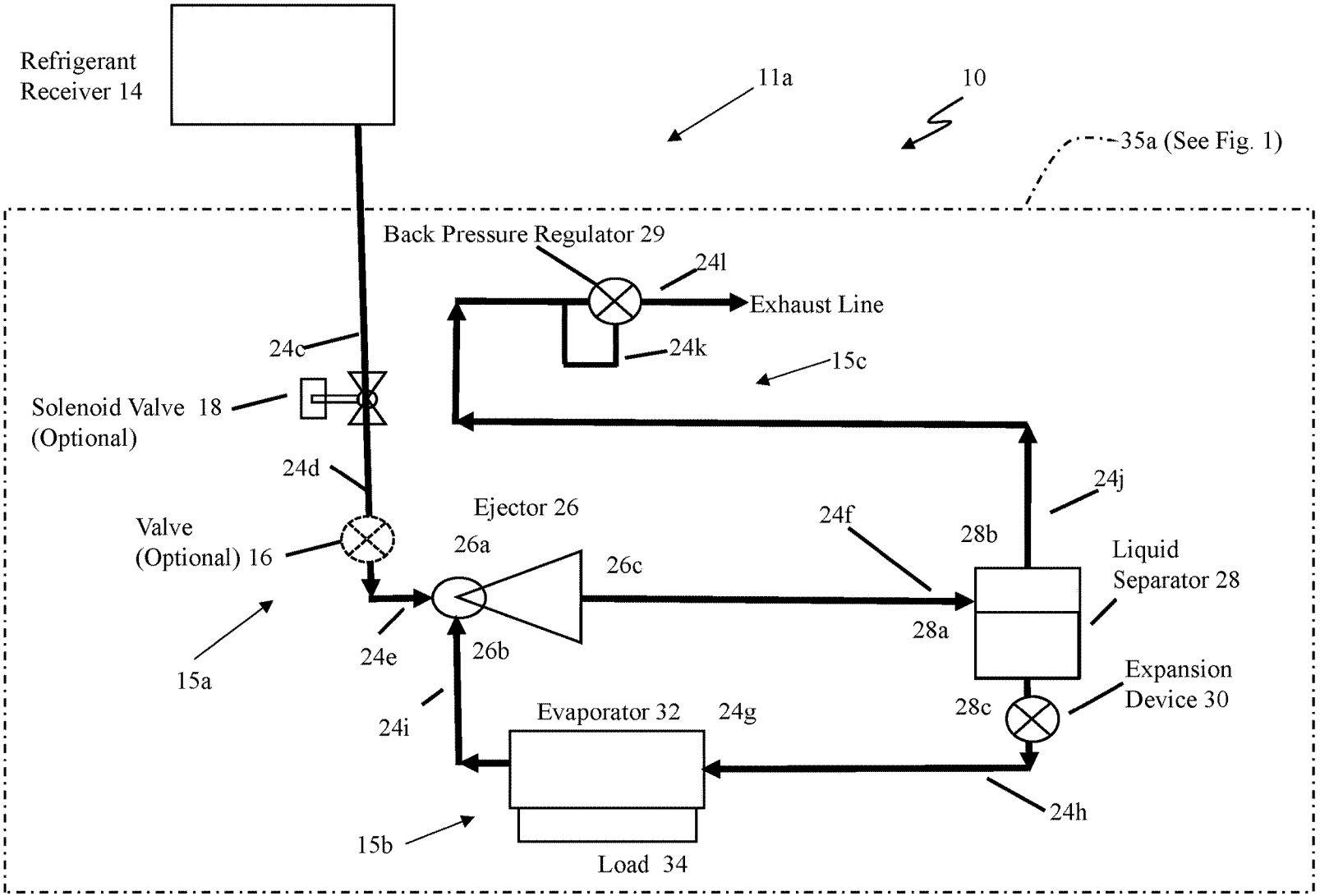
FIGS. 9A-9G are schematic diagrams of alternative examples of a thermal management system that includes an open circuit refrigeration system with ejector, but without a gas receiver.
Figure 9B:
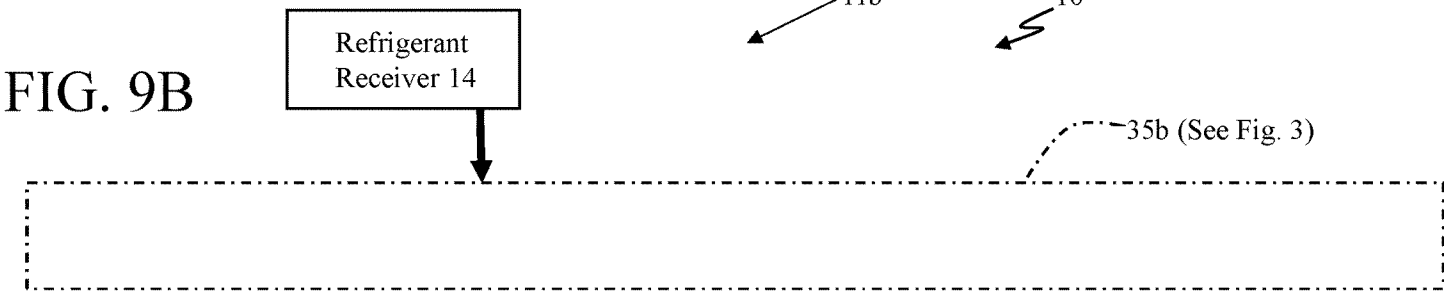
Figure 9C:
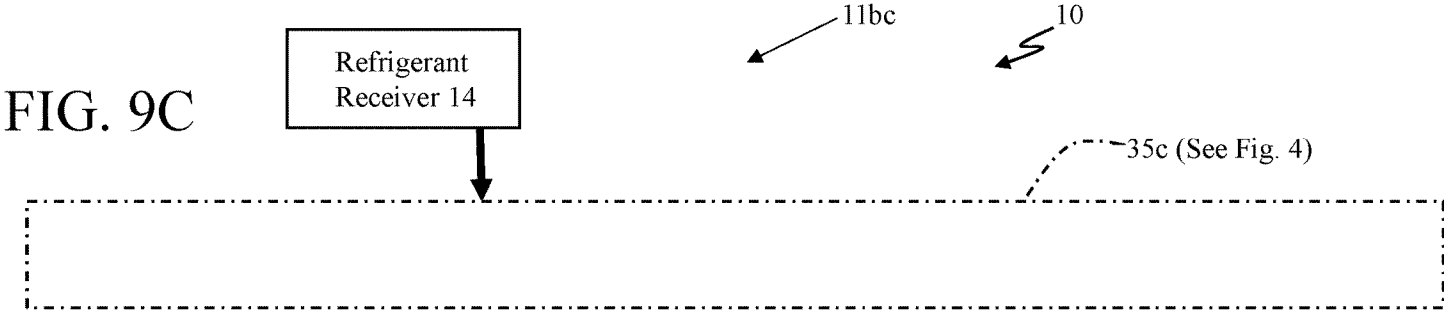
Figure 9D:
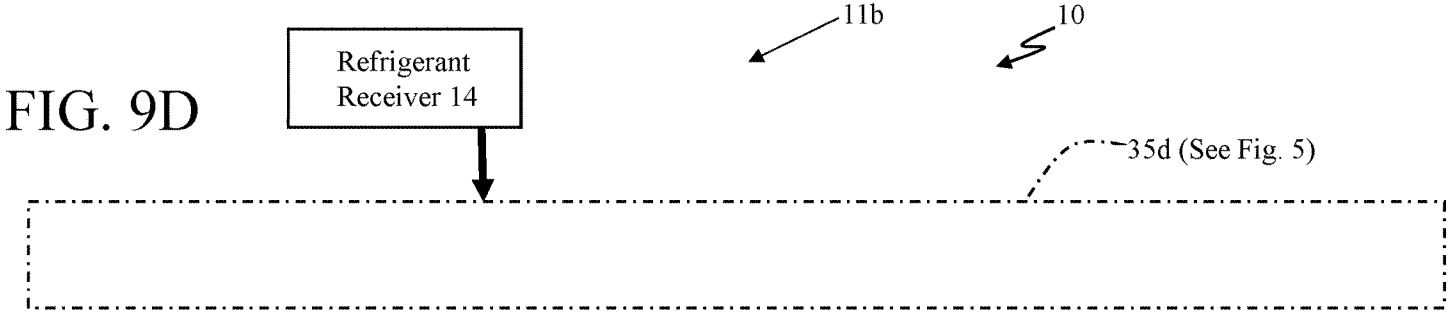
Figure 9E:
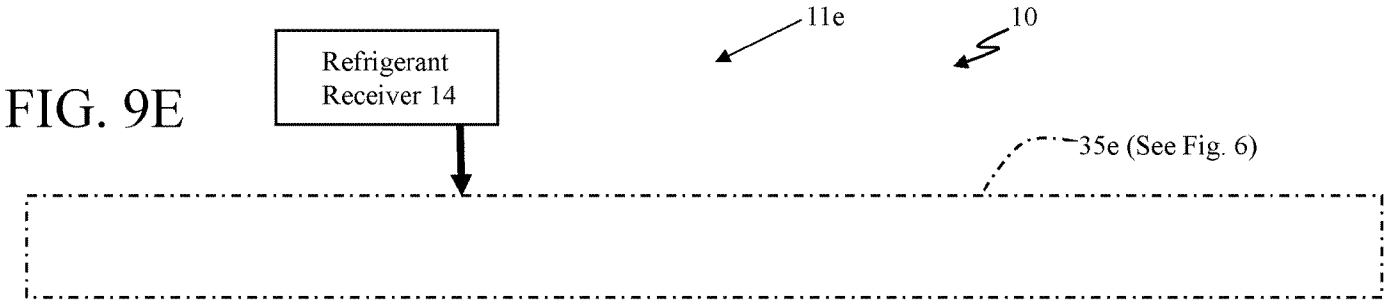
Figure 9F:
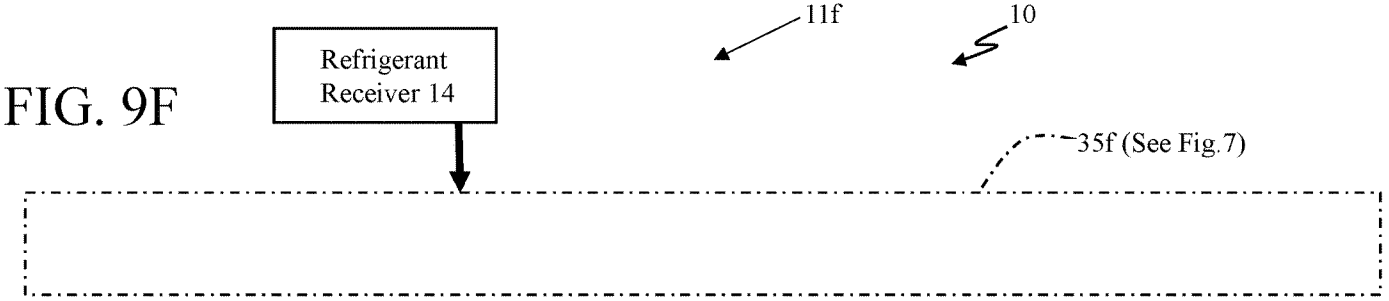
Figure 9G:
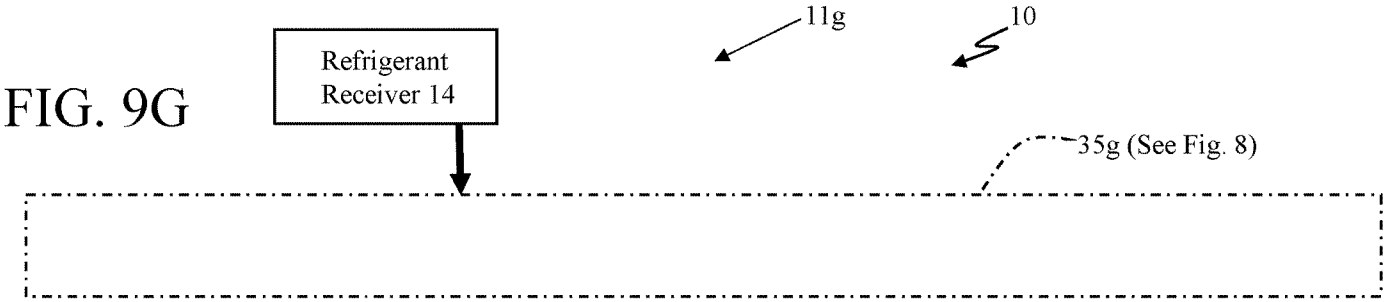

Referring to FIG. 9A, OCRSE 11*a* is similar to OCRSE 10*a* (FIG. 1) except that OCRSE 11*a* does not include the first receiver 12 (FIG. 1) or the control device 13 of FIG. 1.

The open circuit refrigeration system with ejector (OCRSE) 11*a* includes the receiver 14 that receives and is configured to store refrigerant. OCRSE 11*a* also may include the optional valve 16 and the optional first control device, such as, a solenoid control valve 18, as discussed above. The OCRSE 11*a* also includes the ejector 26 with its primary inlet or high pressure inlet 26*a* coupled to the receiver 14 (either directly or through the optional valve 16 and/or solenoid valve 18) the liquid separator 28, the evaporator 32, the expansion device 30 and the back pressure regulator 29 that feeds an Exhaust Line. The operation is similar to that of FIG. 1, except that there is no supply of gas to maintain vapor pressure in the receiver 14.

Pressure in the ammonia receiver will change during operation since there is no gas receiver 12 controlling the pressure. This complicates the control function of the expansion valve 16 which receives the refrigerant flow at reducing pressure. For example, in some embodiments, control device 16 is adjusted (e.g., automatically or by controller 72 FIG. 15) based on a measurement of the evaporation pressure (pe) of the refrigerant fluid and/or a measurement of the evaporation temperature of the refrigerant fluid. With first control device 16 adjusted in this manner, second control device 29 can be adjusted (e.g., automatically or by controller 72) based on measurements of one or more of the following system parameter values: the pressure drop across first control device 16, the pressure drop across evaporator 32, the refrigerant fluid pressure in receiver 12, the vapor quality of the refrigerant fluid emerging from evaporator 32 (or at another location in the system), the superheat value of the refrigerant fluid, and the temperature of thermal load 34.

In certain embodiments, first control device 16 is adjusted (e.g., automatically or by controller 72) based on a measurement of the temperature of thermal load 34. With first control device 16 adjusted in this manner, second control device 29 can be adjusted (e.g., automatically or by controller 72) based on measurements of one or more of the following system parameter values: the pressure drop across first control device 16, the pressure drop across evaporator 32, the refrigerant fluid pressure in receiver 12, the vapor quality of the refrigerant fluid emerging from evaporator 32 (or at another location in the system), the superheat value of the refrigerant fluid, and the evaporation pressure (pe) and/or evaporation temperature of the refrigerant fluid.

In some embodiments, controller 72 second control device 29 based on a measurement of the evaporation pressure pe of the refrigerant fluid downstream from first control device 16 (e.g., measured by sensor 604 or 606) and/or a measurement of the evaporation temperature of the refrigerant fluid (e.g., measured by sensor 614). With second control device 29 adjusted based on this measurement, controller 72 can adjust first control device 16 based on measurements of one or more of the following system parameter values: the pressure drop (pr−pe) across first control device 16, the pressure drop across evaporator 32, the refrigerant fluid pressure in receiver 12 (*pr*), the vapor quality of the refrigerant fluid emerging from evaporator 32 (or at another location in the system), the superheat value of the refrigerant fluid in the system, and the temperature of thermal load 34.

In certain embodiments, controller 72 adjusts second control device 29 based on a measurement of the temperature of thermal load 34 (e.g., measured by a sensor). Controller 72 can also adjust first control device 16 based on measurements of one or more of the following system parameter values: the pressure drop ($p_r$−$p_e$) across first control device 16, the pressure drop across evaporator 32, the refrigerant fluid pressure in receiver 12 ($p_r$), the vapor quality of the refrigerant fluid emerging from evaporator 32 (or at another location in the system), the superheat value of the refrigerant fluid in the system, the evaporation pressure ($p_e$) of the refrigerant fluid, and the evaporation temperature of the refrigerant fluid.

To adjust either first control device 16 or second control device 29 based on a particular value of a measured system parameter value, controller 72 compares the measured value to a set point value (or threshold value) for the system parameter. Certain set point values represent a maximum allowable value of a system parameter, and if the measured value is equal to the set point value (or differs from the set point value by 10% or less (e.g., 5% or less, 3% or less, 1% or less) of the set point value), controller 72 adjusts first control device 16 and/or second control device 29 to adjust the operating state of the system, and reduce the system parameter value.

Certain set point values represent a minimum allowable value of a system parameter, and if the measured value is equal to the set point value (or differs from the set point value by 10% or less (e.g., 5% or less, 3% or less, 1% or less) of the set point value), controller 72 adjusts first control device 16 and/or second control device 29 to adjust the operating state of the system, and increase the system parameter value.

Some set point values represent "target" values of system parameters. For such system parameters, if the measured parameter value differs from the set point value by 1% or more (e.g., 3% or more, 5% or more, 10% or more, 20% or more), controller 72 adjusts first control device 16 and/or second control device 29 to adjust the operating state of the system, so that the system parameter value more closely matches the set point value.

Measured parameter values are assessed in relative terms based on set point values (i.e., as a percentage of set point values). Alternatively, in some embodiments, measured parameter values can be accessed in absolute terms. For example, if a measured system parameter value differs from a set point value by more than a certain amount (e.g., by 1 degree C. or more, 2 degrees C. or more, 3 degrees C. or more, 4 degrees C. or more, 5 degrees C. or more), then controller 72 adjusts first control device 16 and/or second control device 29 to adjust the operating state of the system, so that the measured system parameter value more closely matches the set point value.

A variety of mechanical connections can be used to attach thermal loads to evaporators and heat exchangers, including (but not limited to) brazing, clamping, welding, etc.

The OCRSE 11*a* can also be viewed as including the three circuits 15*a*, 15*b* and 15*c*, as described in FIG. 1. Each of the embodiments of the OCRSE, as described above in FIGS. 3-8, can omit the first receiver 12.

A variety of different refrigerant fluids can be used in OCRSE 10. For open circuit refrigeration systems in general, emissions regulations and operating environments may limit the types of refrigerant fluids that can be used. For example, in certain embodiments, the refrigerant fluid can be ammonia having very large latent heat; after passing through the cooling circuit, vaporized ammonia that is captured at the vapor port of the liquid separator can be disposed of by incineration, by chemical treatment (i.e., neutralization), and/or by direct venting to the atmosphere. Any liquid captured in the liquid separator is recycled back into the OCRSE (either directly or indirectly), via the ejector 26.

Since liquid refrigerant temperature is sensitive to ambient temperature, the density of liquid refrigerant changes even though the pressure in the receiver 14 remains the same. Also, the liquid refrigerant temperature impacts the vapor quality at the evaporator inlet. Therefore, the refrigerant mass and volume flow rates change and the control devices 13, 16 and 29 can be used.

Referring now to FIGS. 9B to 9G, these figures show systems 11*b*-11*g* that are analogs to the systems 10*b*-10*g* (FIGS. 3-8), as discussed above. Systems 11*b*-11*g* are constructed similar to and would operate similar as systems 10*b*-10*g* (FIGS. 3-8), but taking into consideration the absence of the gas receivers as in the systems 10*b*-10*g*. In the interests of brevity the details of these systems 11*b*-11*g* are not discussed here, but the reader is referred to the analogous discussion of systems 10*b*-10*g* (FIGS. 3-8), above.

Figure 10:
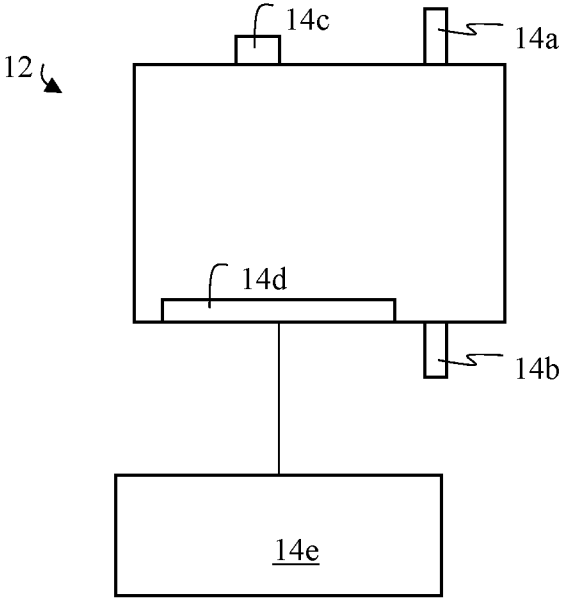
FIG. 10 is a schematic diagram of an example of a receiver for refrigerant fluid in the thermal management system.

FIG. 10 shows a schematic diagram of an example of receiver 14 (or receiver 12). Receiver 14 includes an inlet port 14*a*, an outlet port 14*b*, a pressure relief valve 14*c*, and a heater 14*d*. To charge receiver 14, refrigerant fluid is typically introduced into receiver 14 via inlet port 14*a*, and this can be done, for example, at service locations. Operating in the field the refrigerant exits receiver 14 through outlet port 14*b* that is connected to conduit 24*a* (FIG. 1). In case of emergency, if the fluid pressure within receiver 14 exceeds a pressure limit value, pressure relief valve 14*c* opens to allow a portion of the refrigerant fluid to escape through valve 14*c* to reduce the fluid pressure within receiver 14.

When ambient temperature is very low and, as a result, pressure in the receiver 14 is low and insufficient to drive refrigerant fluid flow through the system, the gas from the gas receiver 12 is used to compress liquid refrigerant in the receiver 14. The gas pressure supplied by the gas receiver 12 compresses the liquid refrigerant in the receiver 14 and maintains the liquid refrigerant in a sub-cooled state even at high ambient and liquid refrigerant temperatures.

A heater 14*d* can be used in embodiments that do not include the gas receiver 12 to control vapor pressure of the liquid refrigerant in the receiver 14. The heater 14 is connected via a control line to a controller (FIG. 13). Heater 14*d*, which can be implemented as a resistive heating element (e.g., a strip heater) or any of a wide variety of different types of heating elements, can be activated by controller to heat the refrigerant fluid within receiver 14. Receiver 14 can also include insulation (not shown in FIG. 2) applied around the receiver to reduce thermal losses.

In general, receiver 14 can have a variety of different shapes. In some embodiments, for example, the receiver is cylindrical. Examples of other possible shapes include, but are not limited to, rectangular prismatic, cubic, and conical. In certain embodiments, receiver 14 can be oriented such that outlet port 14*b* is positioned at the bottom of the receiver. In this manner, the liquid portion of the refrigerant fluid within receiver 14 is discharged first through outlet port 14*b*, prior to discharge of refrigerant vapor. In certain embodiments, the refrigerant fluid can be an ammonia-based mixture that includes ammonia and one or more other substances. For example, mixtures can include one or more additives that facilitate ammonia absorption or ammonia burning.

More generally, any fluid can be used as a refrigerant in the open circuit refrigeration systems disclosed herein, provided that the fluid is suitable for cooling heat load 34*a* (e.g., the fluid boils at an appropriate temperature) and, in embodiments where the refrigerant fluid is exhausted directly to the environment, regulations and other safety and operating considerations do not inhibit such discharge.

Figure 11A:
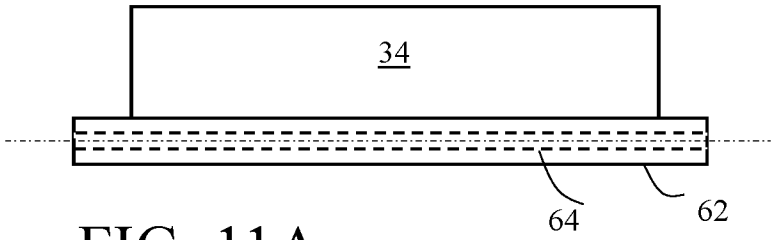
FIGS. 11A and 11B are schematic diagrams showing side and end views, respectively, of an example of the thermal load that includes refrigerant fluid channels.
Figure 11B:
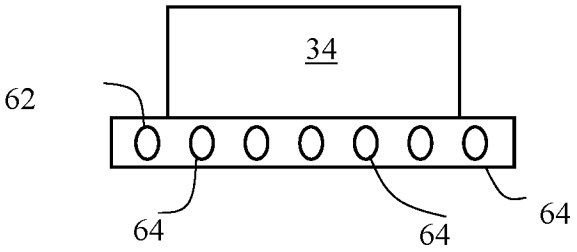

FIGS. 11A and 11B show side and end views, respectively, of a heat load 34 on a thermally conductive body 62 with one or more integrated refrigerant fluid channels 64. The body 62 supporting the heat load 34, which has the refrigerant fluid channel(s) 62 effectively functions as the evaporator 32 for the system. The thermally conductive body 62 can be configured as a cold plate or as a heat exchanging element (such as a mini-channel heat exchanger). Alternatively, the heat loads 34 can be attached to both sides of the thermally conductive body.

During operation of system 10, cooling can be initiated by a variety of different mechanisms. In some embodiments, for example, system 10 includes a temperature sensor attached to load 34. When the temperature of load 34 exceeds a certain temperature set point (i.e., threshold value), a controller (FIG. 13) connected to the temperature sensor can initiate cooling of load 34. Alternatively, in certain embodiments, system 10 operates essentially continuously—provided that the refrigerant fluid pressure within receiver 14 is sufficient—to cool load 34. As soon as receiver 14 is charged with refrigerant fluid, refrigerant fluid is ready to be directed into evaporator 32 to cool load 34. In general, cooling is initiated when a user of the system 10 or the heat load 34 issues a cooling demand.

Upon initiation of a cooling operation, refrigerant fluid from receiver 14 is discharged from the outlet of the receiver 14 and transported through conduit 24*c*, through optional valve 16, if present, and is transported through conduit 24*d* to first control device 18, if present, which directly or indirectly controls vapor quality at the evaporator outlet. In the following discussion, valve 16 and control device 18 are not present and thus refrigerant fluid from receiver 14 enters via conduit 24*e* into the primary inlet of the ejector 26.

Once inside the ejector 26, the refrigerant fluid undergoes constant enthalpy expansion from an initial pressure $p_r$ (i.e., the receiver pressure) to an evaporation pressure $p_e$ at the outlet of the ejector 26. In general, the evaporation pressure $p_e$ depends on a variety of factors, most notably the desired temperature set point value (i.e., the target temperature) at which load 34 is to be maintained and the heat input generated by the heat load.

The initial temperature in the receiver 14 tends to be in equilibrium with the surrounding temperature, and the initial temperature establishes an initial pressure that is different for different refrigerants. The pressure in the evaporator 32 depends on the evaporating temperature, which is lower than the heat load temperature, and is defined during design of the system, as well as subsequent recirculation of refrigerant from the expansion valve 30, which in entrained by the primary flow. The system 10 is operational as long the receiver-to-evaporator pressure difference is sufficient to drive adequate refrigerant fluid flow through the ejector 26.

At some point the first or gas receiver 12 feeds gas via pressure regulator and conduits 24*a*, 24*b* into the second or refrigerant receiver 14. The gas flow can occur at activation of the OCRSP 10*b* or can occur at some point after activation of the OCRSP 10*b*. Similar operational factors apply for OCRSP 10*a* and OCRSP's 10*c*-10*g*.

After undergoing expansion in the ejector 26, the liquid refrigerant fluid is converted to a mixture of liquid and vapor phases at the temperature of the fluid and evaporation pressure $p_e$. The refrigerant fluid in the two-phase state is transported via conduit 24*f* to the liquid separator 28. Liquid from the liquid separator is fed to the expansion valve 30 is converted to a mixture of liquid and vapor phases at the temperature of the fluid and evaporation pressure $p_e$.

When the refrigerant fluid in the two-phase state is directed into evaporator 32, the liquid phase absorbs heat from load 34, driving a phase transition of the liquid refrigerant fluid into the vapor phase. Because this phase transition occurs at (nominally) constant temperature, the temperature of the refrigerant fluid two-phase state within evaporator 32 remains unchanged, provided at least some liquid refrigerant fluid remains in evaporator 32 to absorb heat.

Further, the constant temperature of the refrigerant fluid in the two-phase state within evaporator 32 can be controlled by adjusting the pressure $p_e$ of the refrigerant fluid, since adjustment of $p_e$ changes the boiling temperature of the refrigerant fluid. Thus, by regulating the refrigerant fluid pressure $p_e$ upstream from evaporator 32 (e.g., using pressure regulator 13), the temperature of the refrigerant fluid within evaporator 32 (and, nominally, the temperature of heat load 34) can be controlled to match a specific temperature set-point value for load 34, ensuring that load 34 is maintained at, or very near, a target temperature. The pressure drop across the evaporator 32 causes a drop of the temperature of the refrigerant mixture (which is the evaporating temperature), but still the evaporator 32 can be configured to maintain the heat load temperature within in the set tolerances.

In some embodiments, for example, the evaporation pressure of the refrigerant fluid can be adjusted by the back pressure regulator 29 to ensure that the temperature of thermal load 34 is maintained to within ±5 degrees C. (e.g., to within ±4 degrees C., to within ±3 degrees C., to within ±2 degrees C., to within ±1 degree C.) of the temperature set point value for load 34.

As discussed above for OCRSE 10*a*, within evaporator 32, a portion of the liquid refrigerant is converted to refrigerant vapor by undergoing a phase change. As a result, the refrigerant fluid two-phase state that emerges from evaporator 32 has a higher vapor quality (i.e., the fraction of the vapor phase that exists in refrigerant fluid mixture) than the refrigerant fluid two-phase state that enters evaporator 32. As the refrigerant fluid two-phase state emerges from evaporator 32, the refrigerant fluid is directed into the secondary (low pressure) inlet of the ejector 26 and is entrained by the primary flow (from receiver 14) fed to the inlet 26*a* of the ejector 26.

The refrigerant fluid emerging from evaporator 32 is transported through conduit 24*j* to back pressure regulator 29, which directly or indirectly controls the upstream pressure, that is, the evaporating pressure $p_e$ in the system. After passing through back pressure regulator 29, the refrigerant fluid is discharged as exhaust through conduit 24*l*, which functions as an exhaust line for system 10. Refrigerant fluid discharge can occur directly into the environment surrounding system 10. Alternatively, in some embodiments, the refrigerant fluid can be further processed; various features and aspects of such processing are discussed in further detail below.

It should be noted that the foregoing, while discussed sequentially for purposes of clarity, occurs simultaneously and continuously during cooling operations. In other words, gas from receiver 12 is continuously being discharged, as needed, into the receiver 14 and the refrigerant fluid is continuously being discharged from receiver 14, undergoing continuous expansion in ejector 26, continuously being separated into liquid and vapor phases in liquid separator 28, vapor is exhausted through back pressure regulator 29, while liquid is flowing through expansion valve 30 into evaporator 32 and from evaporator 32 into the low pressure inlet of the ejector 26, which flow is entrained by the primary flow. Refrigerant flows continuously through evaporator 32 while thermal load 34 is being cooled.

During operation of system 10, as refrigerant fluid is drawn from receiver 14 and used to cool thermal load 34, the receiver pressure $p_r$ falls. However, this pressure can be maintained by gas from gas receiver 12 (for embodiments 10*a*-10*g*). With either embodiments 10*a*-10*g* or 11*a*, if the refrigerant fluid pressure $p_r$ in receiver 14 is reduced to a value that is too low, the pressure differential $p_r - p_e$ may not be adequate to drive sufficient refrigerant fluid mass flow to provide adequate cooling of thermal load 34. Accordingly, when the refrigerant fluid pressure $p_r$ in receiver 14 is reduced to a value that is sufficiently low, the capacity of system 10 to maintain a particular temperature set point value for load 34 may be compromised. Therefore, the pressure in the receiver or pressure drop across the expansion valve 30 (or any related refrigerant fluid pressure or pressure drop in system 10) can be an indicator of the remaining operational time. An appropriate warning signal can be issued (e.g., by the controller) to indicate that in certain period of time, the system may no longer be able to maintain adequate cooling performance; operation of the system can even be halted if the refrigerant fluid pressure in receiver 14 reaches the low-end threshold value.

It should be noted that while in FIG. 1 only a single receiver 14 is shown, in some embodiments, system 10 can include multiple receivers 14 to allow for operation of the system 10 over an extended time period. Each of the multiple receivers 14 can supply refrigerant fluid to the system 10 to extend to total operating time period. Some embodiments may include plurality of evaporators connected in parallel, which may or may not accompanied by plurality of expansion valves and plurality of evaporators.

The refrigerant fluid that emerges from the vapor side 28*b* of the liquid separator 28 is all or nearly all in the vapor phase. As in OCRSE 10*f*, 10*g*, the refrigerant fluid vapor (at a saturated or very high vapor quality fluid vapor, e.g., about 0.95 or higher) can be directed into a heat exchanger coupled to another thermal load, and can absorb heat from the additional thermal load during propagation through the heat exchanger to cool additional thermal loads as discussed in more detail subsequently.

III. System Operational Control

As discussed in the previous section, by adjusting the pressure $p_e$ of the refrigerant fluid, the temperature at which the liquid refrigerant phase undergoes vaporization within evaporator 32 can be controlled. Thus, in general, the temperature of heat load 34 can be controlled by a device or component of system 10 that regulates the pressure of the refrigerant fluid within evaporator 32. Typically, back pressure regulator device 29 (which can be implemented as other types of devices to provide back pressure regulation) adjusts the upstream refrigerant fluid pressure in system 10. Accordingly, back pressure regulator device 29 is generally configured to control the temperature of heat load 34, and can be adjusted to selectively change a temperature set point value (i.e., a target temperature) for heat load 34.

Another system operating parameter is the vapor quality of the refrigerant fluid emerging from evaporator 32. Vapor quality is a number from 0 to 1 and represents the fraction of the refrigerant fluid that is in the vapor phase. Because heat absorbed from load 34 is used to drive a constant-temperature evaporation of liquid refrigerant to form refrigerant vapor in evaporator 32, it is generally important to ensure that, for a particular volume of refrigerant fluid propagating through evaporator 32, at least some of the refrigerant fluid remains in liquid form right up to the point at which the refrigerant exits the evaporator 32 to allow continued heat absorption from the load 34 without causing a temperature increase of the refrigerant fluid. If the fluid is fully converted to the vapor phase after propagating only partially through evaporator 32, further heat absorption by the (now vapor-phase or two-phase with vapor quality above the critical one driving the evaporation process in the dry-out) refrigerant fluid within evaporator 32 will lead to a temperature increase of the refrigerant fluid and heat load 34.

On the other hand, liquid-phase refrigerant fluid that emerges from evaporator 32 represents unused heat-absorbing capacity, in that the liquid refrigerant fluid did not absorb sufficient heat from load 34 to undergo a phase change. To ensure that system 10 operates efficiently, the amount of unused heat-absorbing capacity should remain relatively small, and should be defined by the critical vapor quality.

In addition, the boiling heat transfer coefficient that characterizes the effectiveness of heat transfer from load 34 to the refrigerant fluid is typically very sensitive to vapor quality. Vapor quality is a thermodynamic property which is a ratio of mass of vapor to total mass of vapor+liquid. As mentioned above, the "critical vapor quality" is a vapor quality=1. When the vapor quality increases from zero towards the critical vapor quality, the heat transfer coefficient increases. However, when the vapor quality reaches the "critical vapor quality," the heat transfer coefficient is abruptly reduced to a very low value, causing dry out within evaporator 32. In this region of operation, the two-phase mixture behaves as superheated vapor.

In general, the critical vapor quality and heat transfer coefficient values vary widely for different refrigerant fluids, and heat and mass fluxes. For all such refrigerant fluids and operating conditions, the systems and methods disclosed herein control the vapor quality at the outlet of the evaporator such that the vapor quality approaches the threshold of the critical vapor quality.

To make maximum use of the heat-absorbing capacity of the two-phase refrigerant fluid state, the vapor quality of the refrigerant fluid emerging from evaporator 32 should nominally be equal to the critical vapor quality. Accordingly, to both efficiently use the heat-absorbing capacity of the two-phase refrigerant fluid and also ensure that the temperature of heat load 34 remains approximately constant at the phase transition temperature of the refrigerant fluid in evaporator 32, the systems and methods disclosed herein are generally configured to adjust the vapor quality of the refrigerant fluid emerging from evaporator 32 to a value that is less than or almost equal to the critical vapor quality.

Another operating consideration for system 10 is the mass flow rate of refrigerant fluid within the system. In open circuit systems with recirculation of non-evaporated liquid the mass flow rate is minimized as long as the system discharges at the highest possible vapor quality, which discharge is defined by liquid separator efficiency. Evaporator 32 can be configured to provide minimal mass flow rate controlling maximal vapor quality, which is the critical vapor quality. By minimizing the mass flow rate of the refrigerant fluid according to the cooling requirements for heat load 34, system 10 operates efficiently. Each reduction in the mass flow rate of the refrigerant fluid (while maintaining the same temperature set point value for heat load 34) means that the charge of refrigerant fluid added to receiver 14 initially lasts longer, providing further operating time for system 10.

Within evaporator 32, the vapor quality of a given quantity of refrigerant fluid varies from the evaporator inlet (where vapor quality is lowest) to the evaporator outlet (where vapor quality is highest). Nonetheless, to realize the lowest possible mass flow rate of the refrigerant fluid within the system, the effective vapor quality of the refrigerant fluid within evaporator 32—even when accounting for variations that occur within evaporator 32—should match the critical vapor quality as closely as possible.

In summary, to ensure that the system operates efficiently and the mass flow rate of the refrigerant fluid is relatively low, and at the same time the temperature of heat load 34 is maintained within a relatively small tolerance, system 10 adjusts the vapor quality of the refrigerant fluid emerging from evaporator 32 to a value such that an effective vapor quality within evaporator 32 matches, or nearly matches, the critical vapor quality.

System 10 is generally configured to control the heat load 34 temperature. In some embodiments of FIG. 1, control device 30 can control the vapor quality of the refrigerant fluid emerging from evaporator 32 in response to information about at least one thermodynamic quantity that is either directly or indirectly related to the vapor quality. Control device 29 typically adjusts the temperature of heat load 34 (via upstream refrigerant fluid pressure adjustments) in response to information about at least one thermodynamic quantity that is directly or indirectly related to the temperature of heat load 34. The one or more thermodynamic quantities upon which adjustment of control device 30 is based are different from the one or more thermodynamic quantities upon which adjustment of second control device 29 is based.

The evaporator 32 can be configured to maintain exit vapor quality below the critical vapor quality. That is, for a given set of requirements, e.g., mass flow rate of refrigerant, ambient operating conditions, set point temperature, heat load, desired vapor quality exiting the evaporator, etc., the physical configuration of the evaporate 32 is determined such that the desired vapor quality would be achieved or substantially achieved. This would entail determining a suitable size, e.g., length, width, shape and materials, of the evaporator given the expected operating conditions. Conventional thermodynamic principles can be used to design such an evaporator for a specific set of requirements. In such an instance where the evaporator 32 is configured to maintain exit vapor quality this could eliminate the need for another control device, e.g., at the input to the evaporator 32.

In general, a wide variety of different measurement and control strategies can be implemented in system 10 to achieve the control objectives discussed above. Generally, the control devices 13, 16, 18, 29 and 30 can be controlled by measuring a thermodynamic quantity upon which signals are produced to control and adjust the respective devices. The measurements can be implemented in various different ways, depending upon the nature of the devices and the design of the system. As an example, embodiments can optionally include mechanical devices that are controlled by electrical signals, e.g., solenoid controlled valves, regulators, etc. The signals can be produced by sensors and fed to the devices or can be processed by controllers to produce signals to control the devices. The devices can be purely mechanically controlled as well.

It should generally be understood that various control strategies, control devices, and measurement devices can be implemented in a variety of combinations in the systems disclosed herein. Thus, for example, any of the control devices can be implemented as mechanically-controlled devices. In addition, systems with mixed control in which one of the devices is a mechanically controlled device and others are electronically-adjustable devices can also be implemented, along with systems in which all of the control devices are electronically-adjustable devices that are controlled in response to signals measured by one or more sensors and or by sensor signals processed by controller (e.g., dedicated or general processor) circuits. In some embodiments, the systems disclosed herein can include sensors and/or measurement devices that measure various system properties and operating parameters, and transmit electrical signals corresponding to the measured information.

Figure 12:
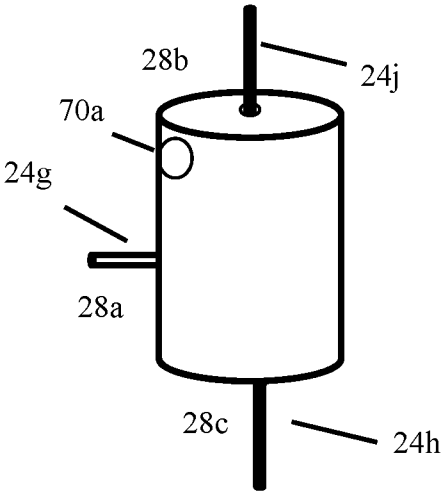
FIG. 12 is a diagrammatical view of a liquid separator.

FIG. 12 depicts an configuration for the liquid separator 28, (implemented as a coalescing liquid separator or a flash drum for example) has ports 28*a*-28*c* coupled to conduits 24*g*, 24*h* and 24*j*, respectively. Other conventional details such as membranes or meshes, etc. are not shown.

Referring now to FIG. 13, the system 10 includes another alternative open circuit refrigeration system with ejector configuration 10*b*''' that is similar to the open circuit refrigeration system with ejector (OCRSE) 10*b* of FIG. 2, including the first receiver 12, the pressure regulator 13, the second receiver 14, the solenoid control valve 18, expansion valve 16, evaporator 32, liquid separator 28, ejector 26 and back pressure regulator 29 coupled to the exhaust line 27, as discussed above in FIG. 2. Conduits 24*a*-24*m* couple the various aforementioned items as shown.

The OCRSP 10*b*''' also includes a recuperative heat exchanger 100 having two fluid paths. A first fluid path is between a first inlet and first outlet of the recuperative heat exchanger 100. The first fluid path has the first inlet of recuperative heat exchanger 100 coupled to the outlet of the receiver 14 and the first outlet of the recuperative heat exchanger 100 coupled to the inlet of the valve 18. A second fluid path is between a second inlet and second outlet of the recuperative heat exchanger 100. The second fluid path has the second inlet of recuperative heat exchanger 100 coupled to the vapor side outlet of the liquid separator 28 and the second outlet of the recuperative heat exchanger 100 is coupled to the inlet of the back pressure regulator 29.

In this configuration, the receiver 14 is integrated with the recuperative heat exchanger 100. The recuperative heat exchanger 100 provides thermal contact between the liquid refrigerant leaving the receiver 14 and the refrigerant vapor from the liquid separator 28. The use of the recuperative heat exchanger 100 at the outlet of the receiver 14 may further reduce liquid refrigerant mass flow rate demand from the receiver 14 by re-using the enthalpy of the exhaust vapor to precool the refrigerant liquid entering the evaporator that reduces the enthalpy of the refrigerant entering the evaporator, and thus reduces mass flow rate demand and provides a relative increase in energy efficiency of the system 10.

The OCRSP 10*b*''' with the recuperative heat exchanger 100 can be used with any of the embodiments 10*a*, 10*c*-10*g* or 11*a*-11*g*.

Figure 13A:
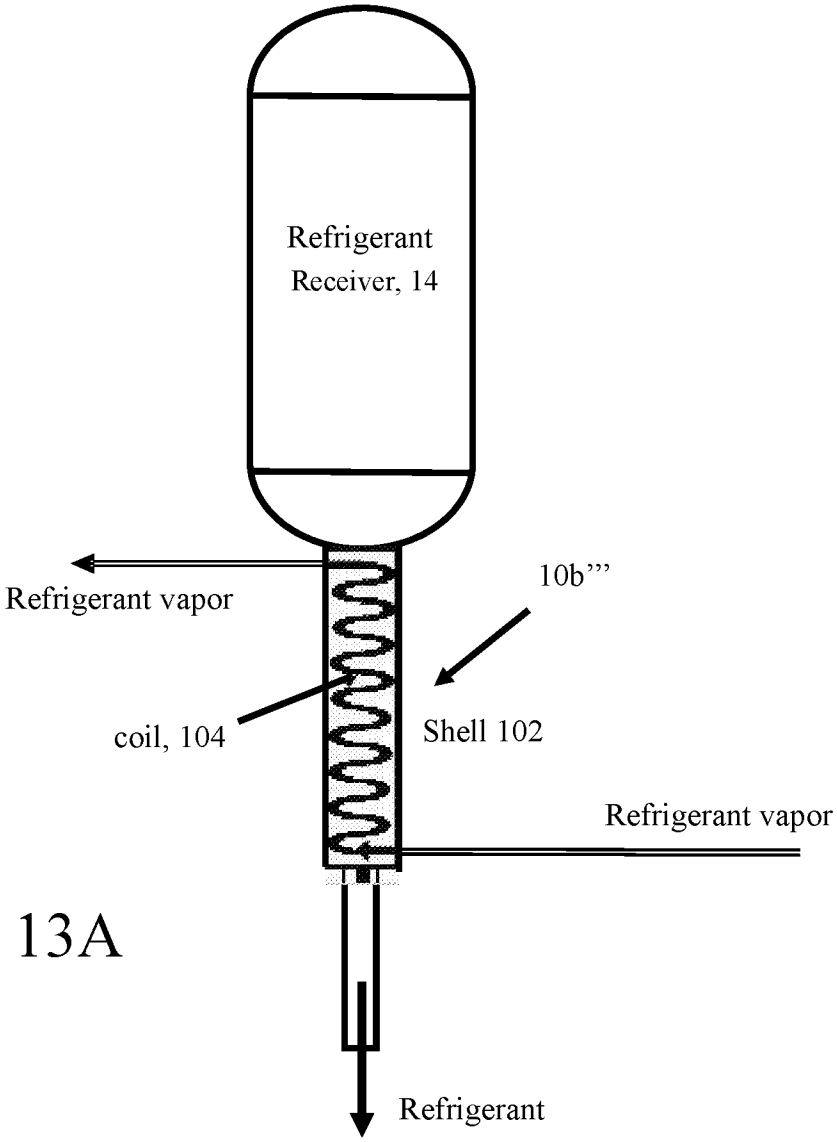
FIG. 13A depicts a recuperative heat exchanger.

Referring now to FIG. 13A, one embodiment of the recuperative heat exchanger 100 is a helical-coil type heat exchanger that includes a shell 102 and a helical coil 104 that is inside the shell 102. The refrigerant liquid stream from the receiver 14 flows though the shell 102 while the vapor stream from the vapor side of the liquid separator flows through the coil 104. The coil 104 can be made of different heat exchanger elements: conventional tubes, mini-channel tubes, cold plate type tubes, etc. The shape of the coil channels can be different as well. Heat from the vapor is transferred from the vapor to the liquid.

Figure 14:
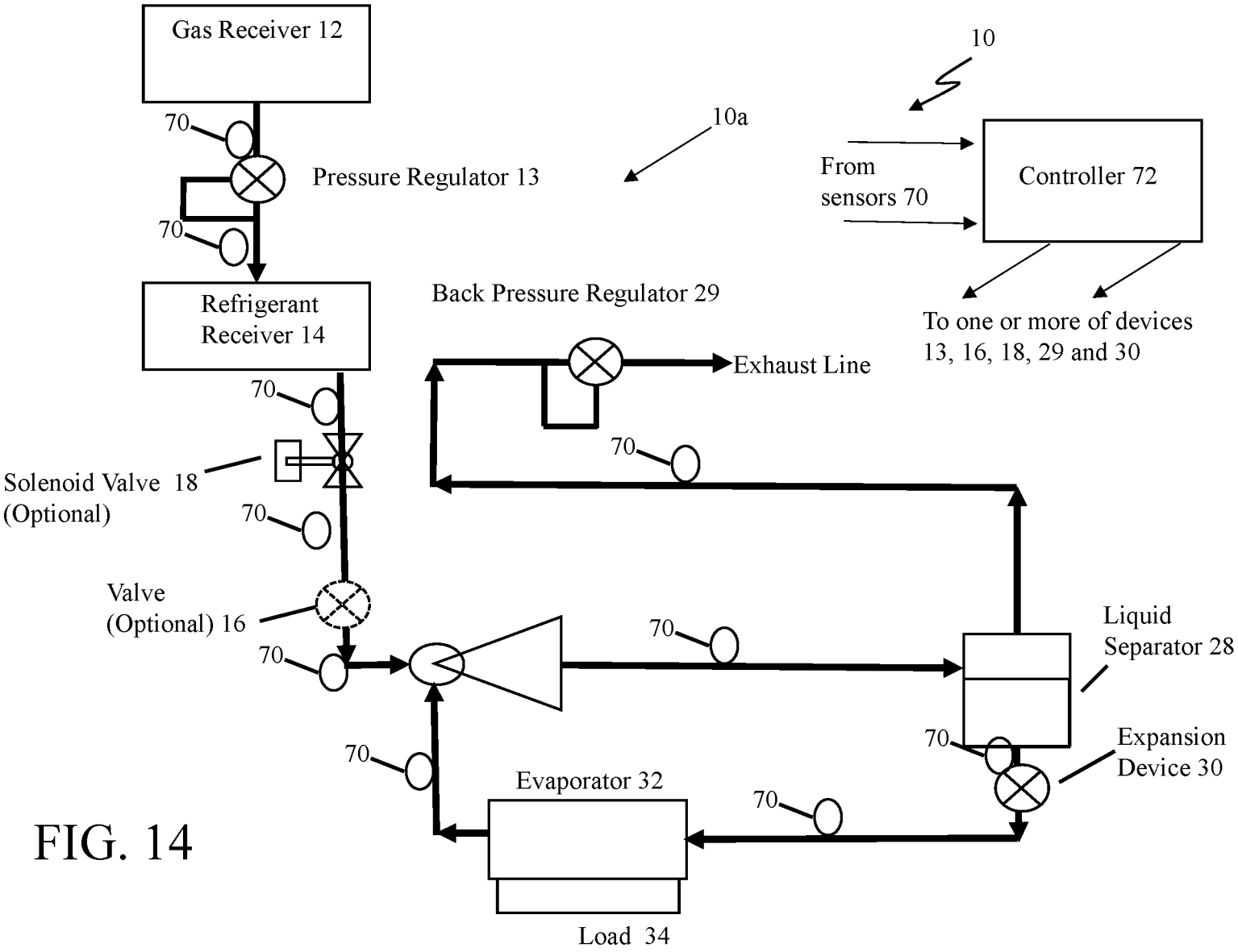
FIG. 14 is a schematic diagram of an example of the thermal management system of FIG. 1 that includes one or more sensors connected/coupled to a controller.

FIG. 14 shows the thermal management system 10 of FIG. 1 with a number of different sensors generally 70 each of which is optional, and various combinations of the sensors shown can be used to measure thermodynamic properties of the system 10 that are used to adjust the control devices 13, 16, 18, 29, and/or 30, 31 and which signals are processed by a controller 72.

Figure 15:
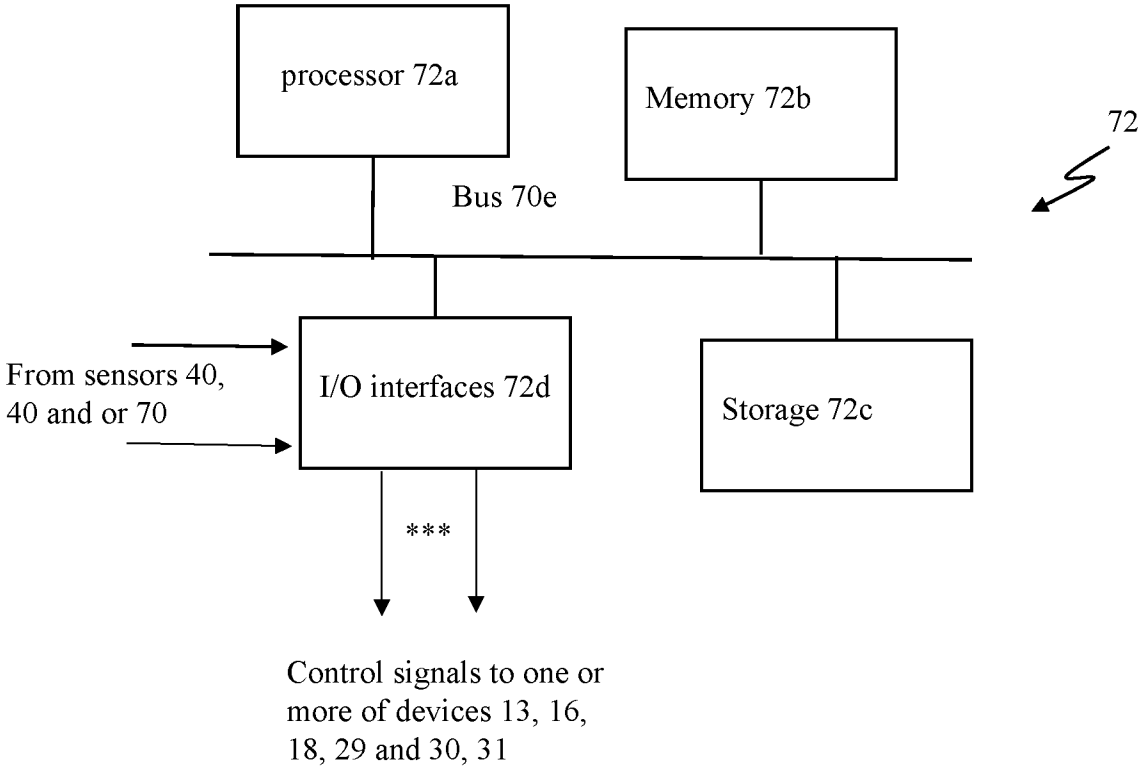
FIG. 15 is a block diagram of a controller.

FIG. 15 shows the controller 72 that includes a processor 72*a*, memory 72*b*, storage 72*c*, and I/O interfaces 72*d*, all of which are connected/coupled together via a bus 70*e*. Any two of the optional devices, as pressure sensors upstream and downstream from a control device can be configured to measure information about a pressure differential $p_r - p_e$ across the respective control device and to transmit electronic signals corresponding to the measured pressure from which a pressure difference information can be generated by the controller 72. Other sensors such as flow sensors and temperature sensors can be used as well. In certain embodiments, sensors can be replaced by a single pressure differential sensor, a first end of which is connected adjacent to an inlet and a second end of which is connected adjacent to an outlet of a device to which differential pressure is to be measured, such as the evaporator. The pressure differential sensor measures and transmits information about the refrigerant fluid pressure drop across the device, e.g., the evaporator 32.

Temperatures sensor can be positioned adjacent to an inlet or an outlet of e.g., the evaporator 32 or between the inlet and the outlet. Such as temperature sensor measures temperature information for the refrigerant fluid within evaporator 32 (which represents the evaporating temperature) and transmits an electronic signal corresponding to the measured information. A temperature sensor can be attached to heat load 34, which measures temperature information for the load and transmits an electronic signal corresponding to the measured information. An optional temperature sensor can be adjacent to the outlet of evaporator 32 that measures and transmits information about the temperature of the refrigerant fluid as it emerges from evaporator 32.

In certain embodiments, the systems disclosed herein are configured to determine superheat information for the refrigerant fluid based on temperature and pressure information for the refrigerant fluid measured by any of the sensors disclosed herein. The superheat of the refrigerant vapor refers to the difference between the temperature of the refrigerant fluid vapor at a measurement point in the system and the saturated vapor temperature of the refrigerant fluid defined by the refrigerant pressure at the measurement point in the system.

To determine the superheat associated with the refrigerant fluid, the system controller 72 (as described) receives information about the refrigerant fluid vapor pressure after emerging from a heat exchanger downstream from evaporator 32, and uses calibration information, a lookup table, a mathematical relationship, or other information to determine the saturated vapor temperature for the refrigerant fluid from the pressure information. The controller 72 also receives information about the actual temperature of the refrigerant fluid, and then calculates the superheat associated with the refrigerant fluid as the difference between the actual temperature of the refrigerant fluid and the saturated vapor temperature for the refrigerant fluid.

The foregoing temperature sensors can be implemented in a variety of ways in system 10. As one example, thermocouples and thermistors can function as temperature sensors in system 10. Examples of suitable commercially available temperature sensors for use in system 10 include, but are not limited to the 88000 series thermocouple surface probes (available from OMEGA Engineering Inc., Norwalk, Conn.).

System 10 can include a vapor quality sensor that measures vapor quality of the refrigerant fluid emerging from evaporator 32. Typically, such a sensor is implemented as a capacitive sensor that measures a difference in capacitance between the liquid and vapor phases of the refrigerant fluid. The capacitance information can be used to directly determine the vapor quality of the refrigerant fluid (e.g., by system controller 72). Alternatively, sensor can determine the vapor quality directly based on the differential capacitance measurements and transmit an electronic signal that includes information about the refrigerant fluid vapor quality. Examples of commercially available vapor quality sensors that can be used in system 10 include, but are not limited to HBX sensors (available from HB Products, Hasselager, Denmark).

The systems disclosed herein can include a system controller 72 that receives measurement signals from one or more system sensors and transmits control signals to the control devices to adjust the refrigerant fluid vapor quality and the heat load temperature.

It should generally understood that the systems disclosed herein can include a variety of combinations of the various sensors described above, and controller 72 can receive measurement information periodically or aperiodically from any of the various sensors. Moreover, it should be understood any of the sensors described can operate autonomously, measuring information and transmitting the information to controller 72 (or directly to the first and/or second control means), or alternatively, any of the sensors described above can measure information when activated by controller 72 via a suitable control signal, and measure and transmit information to controller 72 in response to the activating control signal.

To adjust a control device on a particular value of a measured system parameter value, controller 72 compares the measured value to a set point value (or threshold value) for the system parameter. Certain set point values represent a maximum allowable value of a system parameter, and if the measured value is equal to the set point value (or differs from the set point value by 10% or less (e.g., 5% or less, 3% or less, 1% or less) of the set point value), controller 72 adjusts a respective control device to modify the operating state of the system 10. Certain set point values represent a minimum allowable value of a system parameter, and if the measured value is equal to the set point value (or differs from the set point value by 10% or less (e.g., 5% or less, 3% or less, 1% or less) of the set point value), controller 72 adjusts the respective control device to modify the operating state of the system 10, and increase the system parameter value. The controller 72 executes algorithms that use the measured sensor value(s) to provide signals that cause the various control devices to adjust refrigerant flow rates, etc.

Some set point values represent "target" values of system parameters. For such system parameters, if the measured parameter value differs from the set point value by 1% or more (e.g., 3% or more, 5% or more, 10% or more, 20% or more), controller 72 adjusts the respective control device to adjust the operating state of the system, so that the system parameter value more closely matches the set point value.

IV. Additional Features of Thermal Management Systems

The foregoing examples of thermal management systems illustrate a number of features that can be included in any of the systems within the scope of this disclosure. In addition, a variety of other features can be present in such systems.

In certain embodiments, refrigerant vapor that is discharged from the liquid separator 28 can be directly discharged through the back-pressure regulator 28, as exhaust without further treatment. Direct discharge provides a convenient and straightforward method for handling spent refrigerant, and has the added advantage that over time, the overall weight of the system is reduced due to the loss of refrigerant fluid. For systems that are mounted to small vehicles or are otherwise mobile, this reduction in weight can be important.

In some embodiments, however, refrigerant fluid vapor can be further processed before it is discharged. Further processing may be desirable depending upon the nature of the refrigerant fluid that is used, as direct discharge of unprocessed refrigerant fluid vapor may be hazardous to humans and/or may deleterious to mechanical and/or electronic devices in the vicinity of the system. For example, the unprocessed refrigerant fluid vapor may be flammable or toxic, or may corrode metallic device components. In situations such as these, additional processing of the refrigerant fluid vapor may be desirable.

V. Integration with Power Systems

In some embodiments, the refrigeration systems disclosed herein can combined with power systems to form integrated power and thermal systems, in which certain components of the integrated systems are responsible for providing refrigeration functions and certain components of the integrated systems are responsible for generating operating power. An integrated power and thermal management system can include many features similar to those discussed above, in addition, the system can include an engine with an inlet that receives the stream of waste refrigerant fluid. The engine can combust the waste refrigerant fluid directly, or alternatively, can mix the waste refrigerant fluid with one or more additives (such as oxidizers) before combustion. Where ammonia is used as the refrigerant fluid in system, suitable engine configurations for both direct ammonia combustion as fuel, and combustion of ammonia mixed with other additives, can be implemented. In general, combustion of ammonia improves the efficiency of power generation by the engine. The energy released from combustion of the refrigerant fluid can be used by engine to generate electrical power, e.g., by using the energy to drive a generator.

VI. Start-Up and Temporary Operation

In certain embodiments, the thermal management systems disclosed herein operate differently at, and immediately following, system start-up, compared to the manner in which the systems operate after an extended running period. Upon start-up, refrigerant fluid in receiver 14 may be relatively cold, and therefore the receiver pressure ($p_r$) may be lower than a typical receiver pressure during extended operation of the system. However, if receiver pressure $p_r$ is too low, the system may be unable to maintain a sufficient mass flow rate of refrigerant fluid through evaporator 32 to adequately cool thermal load 34. As discussed in connection with FIG. 2, however, the non-condensable gas in the gas receiver 12 provides necessary pressure elevation in the refrigerant receiver 102 to enable smooth start-up and allow the system to deliver refrigerant fluid into evaporator 106 at a sufficient mass flow rate.

Receiver 14 can optionally include a heater (14*d* shown in FIG. 10), especially useful in embodiments where the gas receiver 12 is not used. The heater can generally be implemented as any of a variety of different conventional heaters, including resistive heaters. In addition, heater can correspond to a device or apparatus that transfers some of the enthalpy of the exhaust from the engine into receiver 14 or a device or apparatus that transfers enthalpy from any other heat source into receiver 14. During cold start-up, controller 72 activates heater to evaporate portion of the refrigerant fluid in receiver 14 and raise the vapor pressure and pressure $p_r$. This allows the system to deliver refrigerant fluid into evaporator 32 at a sufficient mass flow rate. As the refrigerant fluid in receiver 14 warms up, heater can be deactivated by controller 72.

VII. Integration with Directed Energy Systems

The thermal management systems and methods disclosed herein can implemented as part of (or in conjunction with) directed energy systems such as high energy laser systems. Due to their nature, directed energy systems typically present a number of cooling challenges, including certain heat loads for which temperatures are maintained during operation within a relatively narrow range. Examples of such systems include a directed energy system, specifically, a high energy laser system. System includes a bank of one or more laser diodes amplifiers and other electronic devices connected to a power source. During operation, laser diodes generate an output radiation beam that is amplified by amplifier, and directed as output beam onto a target. Generation of high energy output beams can result in the production of significant quantities of heat. Certain laser diodes, however, are relatively temperature sensitive, and the operating temperature of such diodes is regulated within a relatively narrow range of temperatures to ensure efficient operation and avoid thermal damage. Amplifiers are also temperature-sensitively, although typically less sensitive than diodes.

VIII. Hardware and Software Implementations

Controller 72 can generally be implemented as any one of a variety of different electrical or electronic computing or processing devices, and can perform any combination of the various steps discussed above to control various components of the disclosed thermal management systems.

Controller 72 can generally, and optionally, include any one or more of a processor (or multiple processors), a memory, a storage device, and input/output device. Some or all of these components can be interconnected using a system bus. The processor is capable of processing instructions for execution. In some embodiments, the processor can be a single-threaded processor. In certain embodiments, the processor can be is a multi-threaded processor. Typically, the processor is capable of processing instructions stored in the memory or on the storage device to display graphical information for a user interface on the input/output device, and to execute the various monitoring and control functions discussed above. Suitable processors for the systems disclosed herein include both general and special purpose microprocessors, and the sole processor or one of multiple processors of any kind of computer or computing device.

The memory stores information within the system, and can be a computer-readable medium, such as a volatile or non-volatile memory. The storage device can be capable of providing mass storage for the controller 72. In general, the storage device can include any non-transitory tangible media configured to store computer readable instructions. For example, the storage device can include a computer-readable medium and associated components, including: magnetic disks, such as internal hard disks and removable disks; magneto-optical disks; and optical disks. Storage devices suitable for tangibly embodying computer program instructions and data include all forms of non-volatile memory, including by way of example semiconductor memory devices, such as EPROM, EEPROM, and flash memory devices; magnetic disks such as internal hard disks and removable disks; magneto-optical disks; and CD-ROM and DVD-ROM disks. Processors and memory units of the systems disclosed herein can be supplemented by, or incorporated in, ASICs (application-specific integrated circuits).

The input/output device provides input/output operations for controller 72, and can include a keyboard and/or pointing device. In some embodiments, the input/output device includes a display unit for displaying graphical user interfaces and system related information.

The features described herein, including components for performing various measurement, monitoring, control, and communication functions, can be implemented in digital electronic circuitry, or in computer hardware, firmware, or in combinations of them. Methods steps can be implemented in a computer program product tangibly embodied in an information carrier, e.g., in a machine-readable storage device, for execution by a programmable processor (e.g., of controller 72), and features can be performed by a programmable processor executing such a program of instructions to perform any of the steps and functions described above. Computer programs suitable for execution by one or more system processors include a set of instructions that can be used, directly or indirectly, to cause a processor or other computing device executing the instructions to perform certain activities, including the various steps discussed above.

Computer programs suitable for use with the systems and methods disclosed herein can be written in any form of programming language, including compiled or interpreted languages, and can be deployed in any form, including as stand-alone programs or as modules, components, subroutines, or other units suitable for use in a computing environment.

In addition to one or more processors and/or computing components implemented as part of controller 72, the systems disclosed herein can include additional processors and/or computing components within any of the control means (e.g., first control device 18 and/or second control device 22) and any of the sensors discussed above. Processors and/or computing components of the control means and sensors, and software programs and instructions that are executed by such processors and/or computing components, can generally have any of the features discussed above in connection with controller 72.

A number of embodiments have been described. Nevertheless, it will be understood that various modifications may be made. Accordingly, other embodiments are within the scope of the following claims.

What is claimed is:

1. A thermal management system, including:

an open circuit refrigeration system that has a refrigerant fluid flow path, with the refrigerant fluid flow path comprising:

a receiver configured to store a refrigerant fluid in a subcooled state;

a recuperative heat exchanger that has a first fluid path that receives the refrigerant fluid from the receiver and a second fluid path that receives refrigerant vapor passed into the recuperative heat exchanger, and which provides thermal contact between the refrigerant from the receiver and the refrigerant vapor passed into the recuperative heat exchanger;

an ejector having a primary flow inlet configured to receive the refrigerant fluid from the first fluid path of the recuperative heat exchanger;

a liquid separator that receives refrigerant fluid at an inlet, and that provides the refrigerant vapor at a first outlet to the second fluid path of the recuperative heat exchanger and refrigerant liquid at a second outlet;

an evaporator configured to extract heat from a heat load that contacts the evaporator, with the evaporator coupled to the ejector and the liquid separator; and an exhaust line coupled to an outlet of the second fluid path of the recuperative heat exchanger, with the exhaust line discharging refrigerant vapor and not returning the refrigerant vapor to the receiver.

2. The system of claim 1 wherein the receiver is a first receiver, and the system further comprises:

a second receiver configured to store a gas to feed the first receiver to compress liquid refrigerant in first receiver and maintain the liquid refrigerant in a sub-cooled state.

3. The system of claim 1 wherein the ejector further has a secondary inlet and the secondary inlet of the ejector is coupled the second outlet of the liquid separator.

4. The system of claim 1 wherein the recuperative heat exchanger reduces liquid refrigerant mass flow rate demand from the receiver.

5. The system of claim 1 wherein the recuperative heat exchanger re-uses enthalpy of the exhaust vapor to precool the refrigerant liquid entering the evaporator to reduce the enthalpy of the refrigerant entering the evaporator to reduce mass flow rate demand of the system.

6. The system of claim 1 wherein the ejector comprises:

a motive nozzle that receives a primary flow from the first receiver;

a secondary nozzle that receives a secondary flow;

a mixing region that receives and mixes the primary flow and the secondary flow to produce a mixed flow; and a diffuser that receives the mixed flow and diffuses the mixed flow and delivers the diffused mixed flow at an outlet of the ejector.

7. The system of claim 1, further comprises:

a first control device configurable to control a vapor quality of the refrigerant fluid at an outlet of the evaporator along the refrigerant fluid flow path.

8. The system of claim 2, further comprises:

a first control device configurable to control a flow of the gas from the first receiver to the second receiver to regulate a vapor pressure in the second receiver.

9. The system of claim 2 further comprises:

a first control device configured to control a flow of the gas from the second receiver to the first receiver to regulate a vapor pressure in the first receiver; and a second control device configured to control a flow of the refrigerant fluid from the recuperative heat exchanger to the primary flow inlet of the ejector.

10. The system of claim 2 further comprises:

a first control device configured to control a flow of the gas from the second receiver to the first receiver to regulate a vapor pressure in the first receiver;

a second control device configured to control a flow of the refrigerant fluid from the recuperative heat exchanger to the primary flow inlet of the ejector;

a third control device configured to control upstream vapor pressure.

11. The system of claim 1 wherein the recuperative heat exchanger further comprises:

a helical-coil type heat exchanger that includes a shell and a helical coil inside the shell.

12. The system of claim 11 wherein the helical-coil type heat exchanger has the refrigerant liquid from the receiver flow through the shell and the refrigerant vapor from the vapor side of the liquid separator flow through the coil.

13. The system of claim 11 wherein heat from the refrigerant vapor is transferred to the refrigerant liquid.

14. The system of claim 1 wherein the first outlet of the liquid separator is a vapor side outlet that receives substantially only refrigerant vapor from the liquid separator and the second outlet is a liquid side outlet that receives substantially only refrigerant liquid from the liquid separator.

15. The system of claim 1 wherein the evaporator is coupled between an outlet of the ejector and an inlet of the liquid separator.

16. The system of claim 2 wherein the evaporator is coupled between the outlet of the ejector and the inlet of the liquid separator.

17. The system of claim 1 wherein the evaporator is coupled between the secondary inlet of the ejector and an outlet of the liquid separator.

18. The system of claim 16 wherein the evaporator is a first evaporator and the heat load is a first heat load, with the system further comprising:

a second evaporator configured to extract heat from a second heat load that contacts the second evaporator, with the second evaporator having an inlet coupled to the second outlet of the liquid separator and the second evaporator having an outlet coupled to the secondary inlet of the ejector.

19. The system of claim 18, further comprising:

a third evaporator configured to extract heat from a third heat load that contacts the third evaporator, the third evaporator having an inlet that is coupled to the second outlet of the liquid separator and having an outlet coupled to a second exhaust line.

20. The system of claim 1, further comprises:

a back pressure regulator configured to receive refrigerant vapor that exits the recuperative heat exchanger after thermally contacting the refrigerant liquid and that is coupled to the exhaust line that exhausts refrigerant vapor.

21. The system of claim 1 wherein for the given set of operating conditions the vapor quality of the refrigerant at the outlet of the evaporator is within a range of 0.6 to 0.95 of vapor to liquid.

22. The system of claim 2 wherein the system further comprises:

a control device configurable to control a flow of the gas from the first receiver to the second receiver to regulate a vapor pressure in the second receiver, an expansion device coupled between an inlet to the evaporator and the first outlet of the liquid separator, configurable to control the vapor quality of the refrigerant fluid emerging from evaporator; and with the control device, the expansion device, the first receiver, the second receiver, the evaporator, the liquid separator, and the exhaust line providing the refrigerant fluid flow path.

23. The system of claim 20 wherein the recuperative heat exchanger has a outlet in the second path, which is coupled to an inlet of the back pressure regulator.

24. The system of claim 1 further comprises:

one or more control devices that are coupled along the refrigerant fluid path;

one or more sensor devices to produce one or more signals that are one or more measures thermodynamic properties of the refrigerant fluid; and a controller that receives the one or more signals and provides one or more control signals to control the one or more control devices.

25. The system of claim 2 wherein the first receiver is configured to store ammonia, and the second receiver is configured to store nitrogen or another inert gas.

26. A thermal management method, comprising:

transporting a primary flow of a refrigerant fluid along a refrigerant fluid flow path that extends from a receiver that stores refrigerant in a subcooled state through a first fluid path in a recuperative heat exchanger and to a primary nozzle of an ejector;

transporting a secondary flow into a secondary nozzle of the ejector within which the primary flow and secondary flow are mixed to provide a mixed flow;

transporting the mixed flow towards a liquid separator;

transporting refrigerant through an evaporator;

extracting heat from a heat load contacting the evaporator;

transporting refrigerant vapor from the liquid separator through a second path in the recuperative heat exchanger to provide thermal contact between refrigerant leaving the receiver and refrigerant vapor passed into the recuperative heat exchanger;

discharging the refrigerant vapor from an exhaust circuit that is coupled to an outlet of the second path in the recuperative heat exchanger so that the discharged refrigerant vapor is not returned to the refrigerant fluid flow path.

27. The method of claim 26 wherein the refrigerant fluid flow path includes a gas receiver and the method further comprises:

transporting a gas from the gas receiver along the refrigerant fluid flow path to the refrigerant receiver.

28. The method of claim 26 wherein refrigerant liquid from the receiver expands at a constant entropy in the ejector and turns into a two-phase state.

29. The method of claim 26 wherein the recuperative heat exchanger reduces refrigerant liquid mass flow rate demand from the receiver.

30. The method of claim 26 wherein the recuperative heat exchanger re-uses enthalpy of the exhaust vapor to precool the refrigerant liquid entering the evaporator to reduce the enthalpy of the refrigerant entering the evaporator to reduce mass flow rate demand of the system.

31. The method of claim 26, further comprises:

controlling by a first control device a vapor quality of the refrigerant fluid at an outlet of the evaporator along the refrigerant fluid flow path.

32. The method of claim 27, further comprises:

controlling by a first control device a flow of the gas from the first receiver to the second receiver to regulate a vapor pressure in the second receiver.

33. The method of claim 27, further comprises:

controlling by a first control device a flow of the gas from the second receiver to the first receiver to regulate a vapor pressure in the first receiver; and controlling by a second control device a flow of the refrigerant fluid from the recuperative heat exchanger through the evaporator.

34. The method of claim 27, further comprises:

controlling by a first control device a flow of the gas from the second receiver to the first receiver to regulate a vapor pressure in the first receiver;

controlling by a second control device a flow of the refrigerant fluid from the recuperative heat exchanger through the evaporator;

controlling by a third control device upstream vapor pressure.

35. The method of claim 27 wherein transporting refrigerant vapor through the second path in the recuperative heat exchanger further comprises:

transporting the refrigerant vapor through a helical-coil in the heat exchanger.

36. The method of claim 26 wherein the refrigerant liquid stream from the receiver flows through a shell of the heat exchanger and the vapor stream from the vapor side of the liquid separator flows through a coil confined in the shell of the heat exchanger.

37. The method of claim 26 wherein heat from the vapor stream is transferred from the refrigerant vapor to the refrigerant liquid.

38. The method of claim 26 wherein the evaporator is coupled between an outlet of the ejector and an inlet of the liquid separator.

39. The method of claim 38 wherein the evaporator is coupled between the outlet of the ejector and the inlet of the liquid separator.

40. The method of claim 26 wherein the evaporator is coupled between the secondary inlet of the ejector and an outlet of the liquid separator.

41. The method of claim 26 wherein the evaporator is a first evaporator and the heat load is a first heat load, and the first evaporator is coupled between the secondary inlet of the ejector and an outlet of the liquid separator, with the method further comprising:

transporting refrigerant fluid from the outlet of the liquid separator to an inlet of a second evaporator having an outlet coupled to the secondary inlet of the ejector, with the second evaporator configured to extract heat from a second heat load that contacts the second evaporator.

42. The method of claim 26 wherein the evaporator is a first evaporator and the heat load is a first heat load, and the first evaporator is coupled between the secondary inlet of the ejector and an outlet of the liquid separator, with the method further comprising:

transporting refrigerant fluid from the outlet of the liquid separator to an inlet of a second evaporator having an outlet coupled to the secondary inlet of the ejector, with the second evaporator configured to extract heat from a second heat load that contacts the second evaporator;

transporting refrigerant fluid from the outlet of the liquid separator to a third evaporator that is configured to extract heat from a third heat load that contacts the third evaporator, the third evaporator having an inlet that is coupled to a liquid side outlet of the liquid separator.

43. The method of claim 26, further comprises:

regulating, with a back pressure regulator, pressure of refrigerant vapor that exits the recuperative heat exchanger after the refrigerant vapor thermally contacts the refrigerant liquid; and exhausting the refrigerant vapor.

44. The method of claim 26 wherein for the given set of operating conditions the vapor quality of the refrigerant at the outlet of the evaporator is within a range of 0.6 to 0.95 of vapor to liquid.

* * * * *